US006229267B1

(12) United States Patent
Ushigusa et al.

(10) Patent No.: US 6,229,267 B1
(45) Date of Patent: May 8, 2001

(54) DISPLAY APPARATUS WITH CAPACITIVE LIGHT-EMITTING DEVICES AND METHOD OF DRIVING THE SAME

(75) Inventors: Yoshihiro Ushigusa; Yoshiyuki Okuda, both of Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/404,542

(22) Filed: Sep. 24, 1999

(30) Foreign Application Priority Data

Sep. 29, 1998 (JP) ..... 10-275425

(51) Int. Cl.[7] ..... G09G 3/10

(52) U.S. Cl. ..... 315/169.4; 340/781; 345/76; 345/214

(58) Field of Search ..... 315/169.3, 169.4, 315/169.2, 169.1, 201; 340/781, 805, 811, 825, 776; 345/37, 55, 60, 76, 78, 214

(56) References Cited

U.S. PATENT DOCUMENTS 4,866,349 * 9/1989 Weber et al. ..... 315/169.4
4,914,353 * 4/1990 Harada et al. ..... 315/169.3
4,975,691 * 12/1990 Lee ..... 340/781
5,081,400 * 1/1992 Weber et al. ..... 315/169.4
5,206,631 * 4/1993 Yamamoto et al. ..... 340/781
5,923,309 * 7/1999 Ishizuka et al. ..... 345/82
6,011,355 * 1/2000 Nagai ..... 315/167.3
6,034,482 * 3/2000 Kanazawa et al. ..... 315/169.4

* cited by examiner

*Primary Examiner*—Don Wong
*Assistant Examiner*—Chuc D Tran
(74) *Attorney, Agent, or Firm*—Sughrue, Mion, Zinn, Macpeak & Seas, PLLC

(57) ABSTRACT

Disclosed is a method for driving a display apparatus with capacitive light-emitting devices, which enables to suppress consumption power. The method includes the steps of; (1) selecting non-connection keeping drive lines among all of the drive lines which are not connected to the drive source in a previous scan period and a present scan period, in the reset period, connecting all of the scan lines to the same reset potential and connecting the selected non-connection keeping drive lines to the ground potential while connecting the other drive lines to the reset potential, or (2) selecting unconnected drive lines among all of the drive lines which are not connected to the drive source in a present scan period, in the reset period, connecting all of the scan lines to the same reset potential and connecting the selected unconnected drive lines to the ground potential while connecting the other drive lines to the reset potential.

96 Claims, 14 Drawing Sheets

DISPLAY APPARATUS WITH CAPACITIVE LIGHT-EMITTING DEVICES AND METHOD OF DRIVING THE SAME

BACKGROUND OF THE INVENTION

1. Field of the Invention

The present invention relates to an image display apparatus and a method for driving the apparatus and, more particularly, to a display apparatus having capacitive light-emitting devices, such as organic electroluminescence devices, and the method for driving the apparatus.

2. Description of the Related Art

An electroluminescence display panel which has a plurality of organic electroluminescence devices arranged in a matrix form is receiving great attention as a display which can have lower power consumption and high display quality and can be suitable for thin-profile display apparatus. As shown in FIG. 1, the organic electroluminescence device has at least a single organic function layer 102, comprised of an electron-transport layer, a light-emitting layer, hole-transport layer, etc., and a metal electrode 103, both formed on a transparent substrate 100 like a glass plate on which a transparent electrode 101 is formed. As a positive voltage is applied to the anode of the transparent electrode 101 and a negative voltage to the cathode of the metal electrode 103, i.e., as a DC voltage is applied between the transparent electrode 101 and the metal electrode 103, the organic function layer 102 emits light. With the organic function layer formed of an organic compound which can be expected to have an excellent emission characteristic, the electroluminescence display can be used practically.

An organic electroluminescence device (hereinafter also referred to as "EL device") can be expressed as an electrically equivalent circuit as shown in FIG. 2. As apparent from the circuit diagram, the device can be replaced with a capacitive component C and a component E with a diode characteristic that is coupled in parallel to the capacitive component C. The EL device is thus a capacitive light-emitting device. When a DC drive voltage is applied between the electrodes of the EL device, charges are stored in the capacitive component C. When the drive voltage exceeds the barrier voltage or emission threshold value inherent to the device, a current starts flowing into the organic function layer that has the light-emitting layer from one of the electrodes (the anode side of the diode component E) and light is emitted with the intensity proportional to the current.

The voltage V v.s. current I v.s. luminance L characteristic of the device is similar to the diode characteristic such that the current I is very small for the voltage equal to or lower than the emission threshold value Vth but abruptly increases when the voltage becomes greater than the emission threshold value Vth, as shown in FIG. 3. The current I is approximately proportional to the luminance L. Such a device provides a luminance proportional to the current that accords to the drive voltage when the drive voltage above the emission threshold value Vth is applied to the device, but it has substantially no drive current flowing when the applied drive voltage is lower than the emission threshold value Vth, so that the luminance stays substantially equal to zero.

Passive matrix driving can be used to drive a display panel which uses a plurality of such EL devices. FIG. 4 exemplifies the structure of a passive matrix display panel. An N number of cathode lines (metal electrodes) $B_1$ to $B_n$ are laid horizontally, and an M number of anode lines (transparent electrodes) $A_1$ to $A_m$ are laid in parallel vertically to cathode lines $B_1$–$B_n$, with light-emitting layers of EL devices $E_{1,1}$ to $E_{m,n}$ placed at (a total of n×m) intersections between the anode lines $A_1$–$A_m$ and the cathode lines $B_1$–$B_n$. The devices $E_{1,1}$ to $E_{m,n}$ which serve as pixels are arranged in a grid pattern, and have their one ends (each of which corresponds to the anode of the diode component E in the aforementioned equivalent circuit) connected to the anode lines $A_1$–$A_m$ at the respective intersections between the vertical anode lines $A_1$–$A_m$ and the horizontal cathode lines $B_1$–$B_n$ and the other ends (each of which corresponds to the cathode of the diode component E in the equivalent circuit) connected to the cathode lines $B_1$–$B_n$. The cathode lines $B_1$–$B_n$ are connected to, and driven by, a cathode-line scan circuit 1, while the anode lines $A_1$–$A_m$ are connected to, and driven by, an anode-line driver 2.

The cathode-line scan circuit 1 has scan switches $\mathbf{5}_1$ to $\mathbf{5}_n$ which are associated with the cathode lines $B_1$–$B_n$ and respectively determine the potentials of the cathode lines $B_1$–$B_n$. Each of the scan switches $\mathbf{5}_1$–$\mathbf{5}_n$ connects either a reverse bias voltage $V_{CC}$ (e.g., 10 V), which is a power supply voltage, or a ground potential (0 V) to the associated cathode line.

The anode-line driver 2 has current sources (e.g., constant current sources) $\mathbf{2}_1$ to $\mathbf{2}_m$ and drive switches $\mathbf{6}_1$ to $\mathbf{6}_m$, which are associated with the anode lines $A_1$–$A_m$ and supply the drive current to the respective devices via the respective anode lines. The anode-line driver 2 performs ON/OFF control on the drive switches $\mathbf{6}_1$–$\mathbf{6}_m$ to let the current flow through the respective anode lines $A_1$–$A_m$ individually. It is typical to use current sources as the drive sources instead of voltage sources like constant voltage sources for reasons such as the aforementioned current v.s. luminance characteristic being stable with respect to a temperature variation whereas the voltage v.s. luminance characteristic is not. The amount of the current to be supplied from each of the current sources $\mathbf{2}_1$–$\mathbf{2}_m$ is set to the amount that is necessary to keep the associated device emitting light at the desired instantaneous luminance (hereinafter this state will be called "steady emission state"). As electrical charges are being stored in the capacitive component C in the device while the device is in the steady emission state, the voltage across the device becomes a specified value Ve (hereinafter called "specified emission voltage").

The anode lines $A_1$–$A_m$ are also connected to an anode-line resetting circuit 3, which has shunt switches $\mathbf{7}_1$–$\mathbf{7}_m$ provided for the respective anode lines. As each shunt switch is selected, the anode-line resetting circuit 3 sets the associated anode line to the ground potential.

The cathode-line scan circuit 1, the anode-line driver 2 and the anode-line resetting circuit 3 are connected to an emission controller 4.

In accordance with image data supplied from an image data generating system (not shown), the emission controller 4 controls the cathode-line scan circuit 1, the anode-line driver 2 and the anode-line resetting circuit 3 to display images carried by the image data. The emission controller 4 controls switching of the scan switches $\mathbf{5}_1$–$\mathbf{5}_n$ to send a scan-line selection control signal to the cathode-line scan circuit 1, select one of the cathode lines that corresponds to the horizontal scan period of the image data, connect the selected cathode line to the ground and apply the reverse bias voltage $V_{CC}$ to the other cathode lines. The reverse bias voltage $V_{CC}$ is applied by a constant voltage source to be connected to each cathode line in order to prevent cross-talk emission from the devices connected at the intersections of the driven anode lines and the cathode lines which are not selected for scanning. The reverse bias voltage $V_{CC}$ is generally set equal to the specified emission voltage Ve. As the scan switches $\mathbf{5}_1$–$\mathbf{5}_n$ are sequentially switched to the ground potential every horizontal scan period, the cathode line which has been switched to the ground potential serves as a scan line which permits the devices connected to the cathode line to emit light.

The anode-line driver 2 performs drive control on the selected scan line. The emission controller 4 generates drive control signals (drive pulses) indicating which device connected to the scan line should be enabled to emit light at what timing and for how long, in accordance with pixel information specified by the image data, and sends the drive control signal to the anode-line driver 2. In accordance with the drive control signal, the anode-line driver 2 implements ON/OFF control on some of the drive switches $\mathbf{6}_1$–$\mathbf{6}_m$ and supplies the drive current to the devices corresponding to the pixel information via the associated anode lines $A_1$–$A_m$. Consequently, the devices supplied with the drive current emit light according to the pixel information.

The reset operation of the anode-line resetting circuit 3 is performed in response to a reset control signal from the emission controller 4. The anode-line resetting circuit 3 sets any of the shunt switches $\mathbf{7}_1$–$\mathbf{7}_m$ which corresponds to the anode line to be reset that is indicated by the reset control signal, and sets off the other shunt switches.

Japanese Laid-Open Patent Publication (KOKAI) No. H 9-232074 of the same applicant as the present application discloses a driving method of executing a reset operation to discharge electrical charges stored in individual devices laid out in a grid pattern on a passive matrix display panel immediately before changing the scan line (this method will be hereinafter called "reset driving method"). The reset driving method quickens the rising of emission of devices at the time the scan line is changed over to another one. The reset driving method for a passive matrix display panel will now be described with reference to FIGS. 4 to 6.

The operation exemplified in FIGS. 4 to 6 is for a case where the cathode line $B_1$ is scanned to permit the devices $E_{1,1}$ and $E_{2,1}$ to emit light, then scanning is shifted to the cathode line $B_2$ to permit the devices $E_{2,2}$ and $E_{3,2}$ to emit light. For easier understanding of the description, the devices which are emitting light are indicated by the symbols of diodes, while the devices which are not emitting light are indicated by the symbols of capacitors. The reverse bias voltage $V_{CC}$ to be applied to the cathode lines $B_1$–$B_n$ is 10 V, the same as the specified emission voltage Ve for the devices.

First, only the scan switch $\mathbf{5}_1$ is switched to the ground potential position and the cathode line $B_1$ is scanned in FIG. 4. The reverse bias voltage $V_{CC}$ is applied to the other cathode lines $B_2$–$B_n$ by the scan switches $\mathbf{5}_2$–$\mathbf{5}_n$. At the same time, the current sources $\mathbf{2}_1$ and $\mathbf{2}_2$ are respectively connected to the anode lines $A_1$ and $A_2$ by the drive switches $\mathbf{6}_1$ and $\mathbf{6}_2$. The other anode lines $A_3$–$A_m$ are switched to the ground potential (earth) position of 0 V by the shunt switches $\mathbf{7}_3$–$\mathbf{7}_m$. In the case of FIG. 4, therefore, only the devices $E_{1,1}$ and $E_{2,1}$ are biased in the forward direction, and the drive current flows into those devices from the current sources $\mathbf{2}_1$ and $\mathbf{2}_2$ as shown by the arrows, causing only the devices $E_{1,1}$ and $E_{2,1}$ to emit light. In this state, the devices $E_{3,2}$ to $E_{m,n}$ which are not emitting light and are indicated by hatching are charged to the illustrated polarity.

The following reset control is executed immediately before scanning is shifted from the steady emission state in FIG. 4 to a state where the next devices $E_{2,2}$ and $E_{3,2}$ emit light. Specifically, as shown in FIG. 5, all the drive switches $\mathbf{6}_1$–$\mathbf{6}_m$ and scan switches $\mathbf{5}_1$–$\mathbf{5}_n$ are connected to the voltage $V_{CC}$ and all the shunt switches $\mathbf{7}_1$–$\mathbf{7}_m$ are opened. When the all-resetting is carried out, all of the anode lines and the cathode lines have the same potential, so that the charges stored in the individual devices are discharged through the routes indicated by the arrows in FIG. 5. As a result, the charges stored in all the devices will vanish instantaneously.

After the charges stored in all the devices are set to zero, only the scan switch $\mathbf{5}_2$ corresponding to the cathode line $B_2$ is switched to the 0 V position to scan the cathode line $B_2$ as shown in FIG. 6. At the same time, the drive switches $\mathbf{6}_2$ and $\mathbf{6}_3$ are closed to connect the current sources $\mathbf{2}_2$ and $\mathbf{2}_3$ to the associated anode lines, and the shunt switches $\mathbf{7}_1$ and $\mathbf{7}_4$–$\mathbf{7}_m$ are switched on to apply 0 V to the anode lines $A_1$ and $A_4$–$A_m$.

As apparent from the above, the emission control in the reset driving method repeats the scan mode during which one of the cathode lines $B_1$–$B_n$ is set active and the following reset mode. The scan mode and reset mode are performed every horizontal scan period (1 H) of image data. If the state in FIG. 4 were shifted to the state in FIG. 6 directly without the reset control, the drive current to be supplied from the current source $\mathbf{2}_3$, for example, not only would flow into the device $E_{3,2}$ but would also be used to cancel the charges of the opposite polarity (shown in FIG. 4) stored in the devices $E_{3,3}$ to $E_{3,n}$. It would therefore take time to render the device $E_{3,2}$ in the steady emission state (to set the voltage across the device $E_{3,2}$ to the specified emission voltage Ve).

Through the above-described reset control, however, the potentials of the anode lines $A_2$ and $A_3$ become approximately $V_{CC}$ the instant scanning is shifted to the cathode line $B_2$, so that the charge current flow into the devices $E_{2,2}$ and $E_{3,2}$ which should emit light next, through a plurality of routes from the constant voltage sources connected to the cathode lines $B_1$ and $B_3$–$B_n$ as well as from the current sources $\mathbf{2}_2$ and $\mathbf{2}_3$. The charge current make the voltages across the devices $E_{2,2}$ and $E_{3,2}$ reach the specified emission voltage Ve instantaneously, thus enabling instantaneous transition to the steady emission state.

Since the conventional reset driving method temporarily resets all of the cathode lines and the anode lines by connecting those lines to the ground potential of 0 V or the same potential as the reverse bias voltage $V_{CC}$ before emission control moves to the next scan line, it is possible to speed up charging of the devices to emit light in the next scan to the emission threshold value Vth at the time the scan line is switched and quicken the rising of emission of the devices on the switched scan line which should emit light.

The charges stored in parallel capacitive components of the devices that are to emit light are discharged before starting each scanning in the passive matrix display panel employing the aforementioned reset driving method. Thus, it has a deficiency that the electrical energy is disadvantageously wasted, particularly when displaying images with low lighting ratio. Paying attention to a case where the EL devices $E_{m,1}$ and $E_{m,2}$ connected to the anode line $A_m$ do not emit light when the scanning target is switched from the cathode line $B_1$ to the cathode line $B_2$ as shown in FIGS. 4 to 6, for example, the power loss of those devices will be explained referring to FIGS. 7A through 7C. As shown in FIG. 7A, while the device $E_{m,1}$ is not charged during the first scanning of the cathode line $B_1$ due to the cathode line $B_1$ and anode line $A_m$ both being at the ground potential, the devices $E_{m,2}$ to $E_{m,n}$ are biased in the reverse direction with the reverse bias voltage $V_{CC}$ and their parallel capacitive components are charged with charges Q via the cathode lines $B_2$–$B_n$. The total amount of charges of the devices on the anode line $A_m$ which are not emitting light becomes (n−1)Q. Next, all-resetting to $V_{cc}$ causes all the charges (n−1)Q to be discharged via the anode line $A_m$ and cathode lines $B_2$–$B_n$, and the charge of the device becomes zero, as shown in FIG. 7B. During the second scanning of the next cathode line $B_2$, as shown in FIG. 7C, each of the parallel capacitive components of the devices $E_{m,1}$ and $E_{m,2}$ to $E_{m,n}$ on the anode line $A_m$ are charged with charges (n−1)Q. When one pays attention to the devices which do not emit light, therefore, wasteful discharging occurs every resetting operation. In other words, in a case where an anode line is reset between the first and second scans and the devices on that anode line, such as the devices $E_{2,1}$ and $E_{2,2}$ on the anode line $A_2$, are rendered off from off, consumed power of charges 2(n−1)Q is wasted. The power loss by the charging and discharging of the parallel capacitive components in a plurality of EL devices of the display panel becomes greater in proportion to the parallel capacitance per unit area and the effective area of the display panel. It is therefore necessary to reduce the power loss.

SUMMARY OF THE INVENTION

Accordingly, it is an object of the present invention to provide a display apparatus with capacitive light-emitting devices, which quickens the rising of light emission without increasing power consumption.

To achieve the object, according to one aspect of the present invention, there is provided a method for driving a display apparatus with capacitive light-emitting devices including a plurality of capacitive light-emitting devices located at a plurality of intersections of drive lines and scan lines and respectively electrically connected between the scan lines and the drive lines, scan switches for connecting the scan lines when activated to one of a first potential and a second potential different from each other, drive switches for connecting the drive lines to either one of the first or second potential or a drive source when activated, and emission control means for controlling the drive switches and the scan switches, whereby the drive switches are activated so as to selectively connect the drive lines to the drive source to allow selected capacitive light-emitting devices to emit light in synchronism with scan timings at which the scan switches connect the scan lines to a lower one of the first and the second potentials, which method comprises the steps of inserting a reset period between each of scan periods; selecting unconnected drive lines among all of the drive lines which are not connected to the drive source in a present scan period in the reset period; and connecting all of the scan lines to the same reset potential, connecting the selected unconnected drive lines to a ground potential, and connecting the other drive lines to the reset potential in the reset period.

According to a second aspect of the present invention, there is provided a method for driving a display apparatus with capacitive light-emitting devices including a plurality of capacitive light-emitting devices located at a plurality of intersections of drive lines and scan lines and respectively electrically connected between the scan lines and the drive lines, scan switches for connecting the scan lines when activated to one of a first potential and a second potential different from each other, drive switches for connecting the drive lines to either one of the first or potential different from each other when activated, and emission control means for controlling the drive switches and the scan switches, whereby the drive switches are activated so as to selectively connect the drive lines to the drive source to allow selected capacitive light-emitting devices to emit light in synchronism with scan timings at which the scan switches connect the scan lines to a lower one of the first and the second potentials, which method comprises the steps of inserting a reset period between each of scan periods; selecting non-connection keeping drive lines among all of the drive lines which are not connected to the drive source in a previous scan period and a present scan period in the reset period; and connecting all of the scan lines to the same reset potential, connecting the selected non-connection keeping drive lines to the ground potential and connecting the other drive lines to the reset potential in the reset period.

In the method according to the present invention, the selection of the unconnected drive lines or the non-connection keeping drive lines is carried out in a reset period immediately before the present scan period.

In the method according to the present invention, one of the first potential and the second potential is a ground potential, while the other one is a potential greater than a potential difference between a specified emission voltage of the capacitive light-emitting devices and an emission threshold voltage.

In the method according to the present invention, one of the first potential and the second potential is a ground potential, while the other one is approximately equal to a specified emission voltage of the capacitive light-emitting devices.

In the method according to the present invention, the reset potential is equal to one of the first and second potentials which has a higher potential.

In the method, the scan line to which the selected capacitive light-emitting devices are connected is connected to the ground potential, and the other scan lines are connected to a potential greater than the potential difference between the specified emission voltage of the capacitive light-emitting devices and the emission threshold voltage in the scan period.

In the method, the scan line to which the selected capacitive light-emitting devices are connected is connected to the ground potential, and the other scan lines are connected to a potential approximately equal to the specified emission voltage of the capacitive light-emitting devices in the scan period.

In the method, drive lines other than the drive line to which the selected capacitive light-emitting devices are connected are connected to the ground potential in the scan period.

In the method according to the first or second aspect, the capacitive light-emitting devices are electroluminescence devices.

In the method according to the present invention, the capacitive light-emitting devices are located at intersections of a plurality of drive lines extending approximately in parallel to one another and a plurality of scan lines extending approximately perpendicularly to the drive lines and approximately in parallel to one another and respectively electrically connected between the scan lines and the drive lines.

Further, according to a third aspect of the present invention, there is provided a display apparatus with capacitive light-emitting devices; comprises a plurality of capacitive light-emitting devices located at a plurality of intersections of drive lines and scan lines and respectively electrically connected between the scan lines and the drive lines; scan switches for connecting the scan lines to one of a first potential and a second potential different from each other when activated; drive switches for connecting the drive lines to either one of the first or potential different from each other when activated; emission control means for controlling the drive switches and the scan switches in such a way that the drive switches are activated so as to connect the drive lines to the drive source to allow selected capacitive light-emitting devices to emit light in synchronism with scan timings at which the scan switches connects the scan lines to a lower one of the first and the second potentials; and discrimination means for selecting unconnected drive lines among all of the drive lines which are not connected to the drive source in a present scan period, whereby the emission control means provides a reset period between each of scan periods, and performs such control as to connect all of the scan lines to the same reset potential, to connect the unconnected drive lines selected by the discrimination means to the ground potential and to connect the other drive lines to the reset potential in the reset period.

According to a fourth aspect of the present invention, there is provided a display apparatus with capacitive light-emitting devices; comprises a plurality of capacitive light-emitting devices located at a plurality of intersections of drive lines and scan lines and respectively electrically connected between the scan lines and the drive lines; scan switches for connecting the scan lines to one of a first potential and a second potential different from each other when activated; drive switches for connecting the drive lines to either one of the first or potential different from each other when activated; emission control means for controlling the drive switches and the scan switches in such a way that the drive switches are activated so as to connect the drive lines to the drive source to allow selected capacitive light-emitting devices to emit light in synchronism with scan timings at which the scan switches connect the scan lines to a lower one of the first and the second potentials; and discrimination means for selecting non-connection keeping drive lines among all of the drive lines which are not connected to the drive source in a previous scan period and a present scan period, whereby the emission control means provides a reset period between each of scan periods, connects all of the scan lines to the same reset potential, connects the non-connection keeping drive lines selected by the discrimination means and connects the other drive lines to the reset potential in the reset period.

Thus, according to the present invention, in contrast to the so-called reset driving method, not all the drive lines are set to the same potential in a reset period, but any drive line which is not connected to the drive source in both the previous and present scan periods or any drive line which is not connected to the drive source in the present scan period is discriminated. The unselected drive lines are connected to the reset potential, while the selected drive lines are connected to the ground potential, not to the reset potential, so that the residual charges in the capacitive components of the devices on the drive lines can be held undischarged. Further, it is possible to avoid charging of the non-emitting devices, which charging does not contribute to light emission. It is therefore possible to provide a display apparatus with capacitive light-emitting devices, which quickens the rising of light emission without increasing power consumption.

DETAILED DESCRIPTION OF THE PREFERRED EMBODIMENTS

Preferred embodiments of the present invention will now be described referring to the accompanying drawings.

Figure 8:
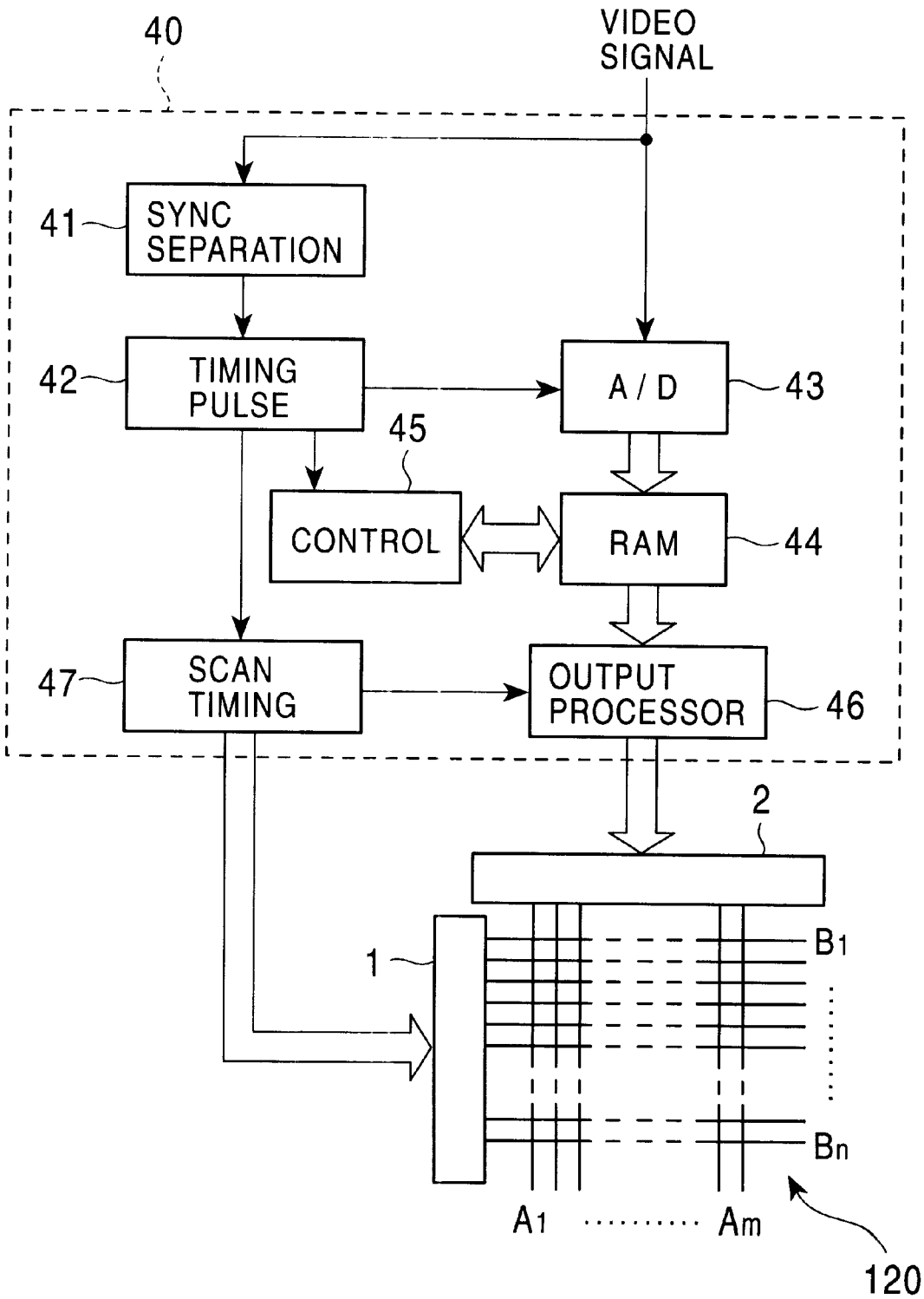
FIG. 8 is a block diagram for explaining the structure of a display apparatus having EL devices according to the present invention.

FIG. 8 is a block diagram for explaining the structure of a display apparatus according to the present invention, which uses organic electroluminescence EL devices (hereinafter simply referred to as "EL device"). The display apparatus has a capacitive light-emitting panel 120 and an emission controller 40. The light-emitting panel 120 comprises a plurality of EL devices $E_{i,j}$ ($1 \leqq i \leqq m$, $1 \leqq j \leqq n$) arranged in a matrix form at the intersections of drive lines like the aforementioned anode lines $A_1$–$A_m$ and scan lines like the aforementioned cathode lines $B_1$–$B_n$. Each of the devices are connected electrically between the associated scan line and drive line. That is, the EL devices are located at the intersections of a plurality of drive lines extending approximately in parallel to one another and a plurality of scan lines extending approximately perpendicularly to the drive lines and approximately in parallel to one another and connected to the respective scan lines and drive lines. The light-emitting panel 120 includes a cathode-line scan circuit 1 or scan switches for connecting the scan lines to one of a ground potential and a reverse bias potential $V_{cc}$ (this is the reset potential) different from each other when activated, and an anode-line driver 2 or drive switches for connecting the drive lines to at least one of the ground potential and the reset potential (reverse bias potential $V_{cc}$) or to a drive source when activated.

Figure 10:
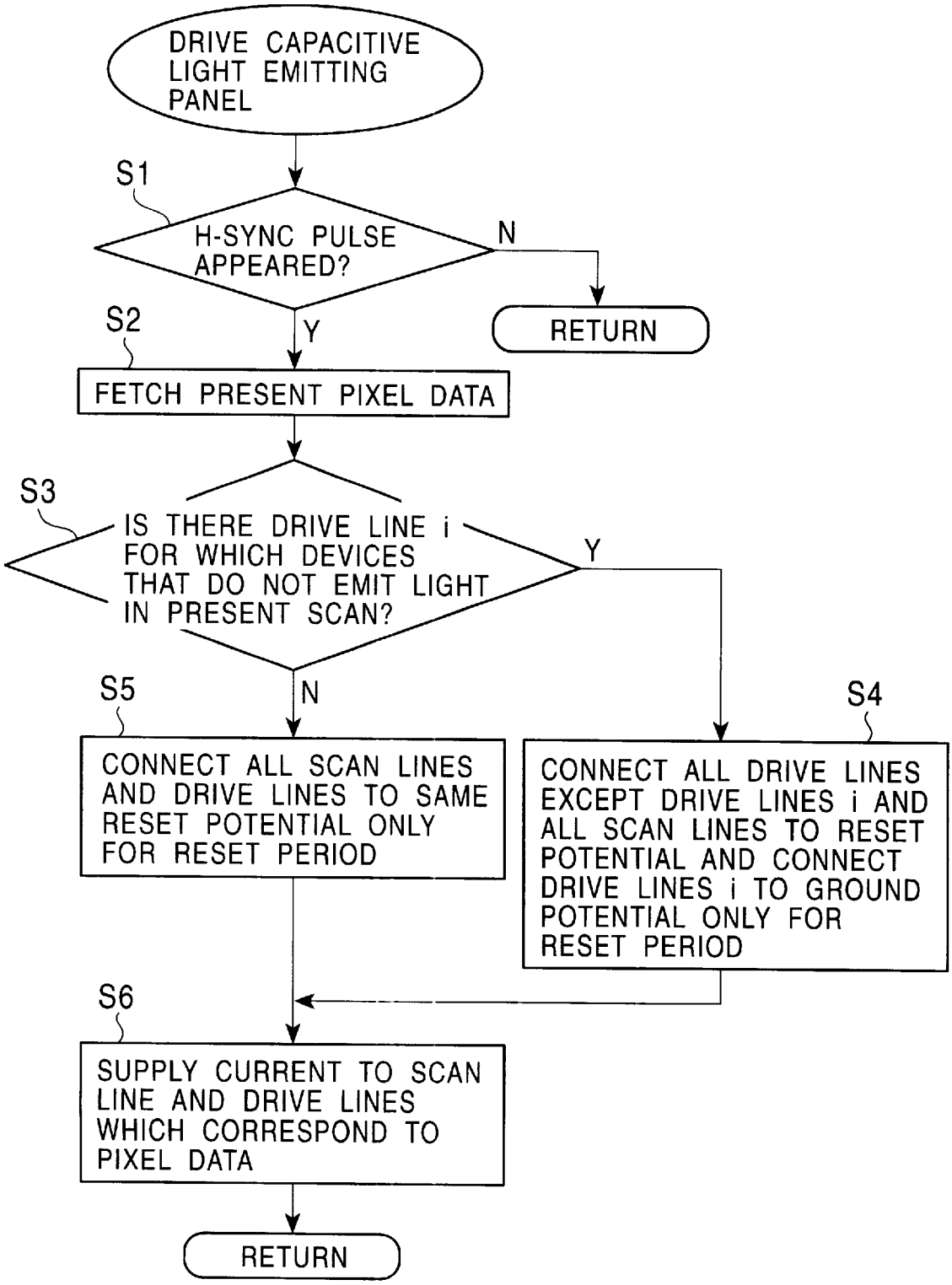
FIG. 10 is a flowchart illustrating a second mode of the reset driving method for the display apparatus according to the present invention.

As shown in FIG. 10, the cathode-line scan circuit 1 has scan switches $\mathbf{5}_1$ to $\mathbf{5}_n$ which are associated with the respective cathode lines $B_1$–$B_n$ and each of which connects either a reverse bias voltage $V_{CC}$ (e.g., 10 V), which is the supply voltage, or the ground potential (0 V) to the associated cathode line. The anode-line driver 2 has current sources $\mathbf{2}_1$ to $\mathbf{2}_m$ which are associated with the anode lines $A_1$–$A_m$ and three-position drive switches $\mathbf{6}_1$ to $\mathbf{6}_m$, which switch to either the current sources $\mathbf{2}_1$–$\mathbf{2}_m$, the reset potential or the ground potential. The anode-line driver 2 performs ON/OFF control on the drive switches $\mathbf{6}_1$–$\mathbf{6}_m$ to let the current flow through the respective anode lines $A_1$–$A_m$ individually. Therefore, the reverse bias voltage $V_{CC}$ should be made greater than the difference, Ve−Vth (Ve: the specified emission voltage, Vth: emission threshold value) to prevent unselected devices from erroneously emitting light. As mentioned above, the reverse bias voltage $V_{CC}$ is generally set equal to the specified emission voltage Ve.

The cathode-line scan circuit 1 performs switch control according to the so-called line-sequential scanning of sequentially switching the cathode lines $B_1$–$B_n$ to the ground potential every horizontal scan period and switching them to the reverse bias voltage $V_{CC}$ in the other periods by using the scan switches. The cathode-line scan circuit 1 may execute interlace scan control instead of the line-sequential scanning. Image data is supplied to the anode lines $A_1$–$A_m$ via the drive switches of the anode-line driver 2. Accordingly, the cathode lines serve as scan lines to enable the devices connected thereto to emit light, and the anode lines serve as drive lines to cause the devices connected thereto to emit light.

The emission controller 40, connected to the cathode-line scan circuit 1 and the anode-line driver 2, serves as emission control means which controls both circuits. The emission controller 40 allows the anode-line driver 2 to selectively connect the drive lines to the respective drive sources, causing the selected devices to emit light, in synchronism with the cyclic scan period in which the cathode-line scan circuit 1 connects one of the scan lines to the ground potential.

In the emission controller 40, a sync separator circuit 41 extracts horizontal and vertical sync signals from an input video signal supplied, and sends those sync signals to a timing pulse generator 42. The timing pulse generator 42 generates a sync signal timing pulse based on the extracted horizontal and vertical sync signals, and sends the timing pulse to an A/D (Analog-to-Digital) converter 43, a control circuit 45 and a scan timing signal generator 47. The A/D converter 43 converts the input video signal to digital pixel data corresponding to one pixel in synchronism with the sync signal timing pulse, and sends the pixel data to a memory 44. The control circuit 45 sends a write signal and read signal synchronous with the sync signal timing pulse to the memory 44 based on a driving method which will be discussed later. The memory 44 sequentially fetches individual pieces of pixel data supplied from the A/D converter 43 in accordance with the write signal. In accordance with the read signal, the memory 44 sequentially reads the stored pixel data and send the data to an output processor 46. The scan timing signal generator 47 generates various kinds of timing signals to control the scan switches and drive switches and send those timing signals to the cathode-line scan circuit 1 and the output processor 46 in the next stage. The output processor 46 sends the pixel data supplied from the memory 44 to the anode-line driver 2 in synchronism with the timing signal from the scan timing signal generator 47.

A first mode of a driving method for the capacitive light-emitting panel which is employed by the emission controller 40 will now be described referring to FIG. 9.

First, the control circuit 45 determines if an H sync pulse indicative of one horizontal scan period (1H) has reached the memory 44 (step 1).

Next, the control circuit 45 fetches image data for the present one horizontal scan period (the j-th scan) from the memory 44 and stores it (step 2).

Then, the control circuit 45 compares the image data for the previous one horizontal scan period that has been stored at the time of the previous scan (the j-1-th scan), with the image data for the present one horizontal scan period (the j-th scan), and determines if there is any drive line i for which the device connected thereto in the previous scan period (the j-1-th scan) did not emit light and the device connected thereto in the present scan period (the j-th scan) neither emit light (step 3).

If it is determined that such a drive line i exists, the control circuit 45 returns image data for the j-th horizontal scan to the memory 44, and controls the drive switches of the anode-line driver 2 via the output processor 46 so as to connect the drive line i to the ground potential and set the other drive lines to the reset potential position. This causes all the drive lines except the drive line i and all the scan lines to connect to the same reset potential and connect the drive line i to the ground potential only for the reset time (step 4).

If it is determined in step 3 that there is no drive line i for which the device connected thereto in the previous scan period (the j-1-th scan) did not emit light and the device connected thereto in the present scan period (the j-th scan) neither emit light, all the drive lines and all the scan lines are connected to the same reset potential only for the reset time (step 5).

After the above reset mode is completed, a predetermined current is supplied to the drive lines that cross the j-th scan line in accordance with the pixel data for the present horizontal scan period (the j-th scan) (step 6).

A second mode of a driving method for the capacitive light-emitting panel which is employed by the emission controller 40 will now be described referring to FIG. 10.

First, as shown in FIG. 10, the control circuit 45 executes steps 1 and 2 in the same way as done in the first mode.

Then, the control circuit 45 determines if there is any drive line i for which the device connected thereto in the present scan period (the j-th scan) does not emit light (step 3').

If it is determined that the drive line i exists, the control circuit 45 controls the drive switches of the anode-line driver 2 via the output processor 46 so as to connect the drive line i to the ground potential and set the other drive lines to the reset potential position (step 4).

If it is determined in step 3 that there is no drive line i for which the device connected thereto in the present scan period (the j-th scan) does not emit light, all the drive lines and all the scan lines are connected to the same reset potential only for the reset time (step 5). After the reset mode is completed, a predetermined current is supplied to the drive lines in accordance with the pixel data for the present horizontal scan period (the j-th scan) (step 6).

A first embodiment of the present invention, which is associated with the first mode of the reset driving method for a passive matrix display panel, will be discussed below referring to FIGS. 11 through 13. In the following operation, after the devices $E_{1,1}$ to $E_{2,1}$ are allowed to emit light in the first scan (the previous scan) of the cathode line $B_1$, the devices $E_{2,2}$ to $E_{3,2}$ are allowed to emit light in the second scan (the present scan) of the cathode line $B_2$, as per the prior art (the same symbolic notation will be used). The reverse bias voltage $V_{CC}$ that is applied to the cathode lines $B_1$–$B_n$ is set equal to the specified emission voltage Ve of the devices. The reset potential is the ground potential.

Figure 11:
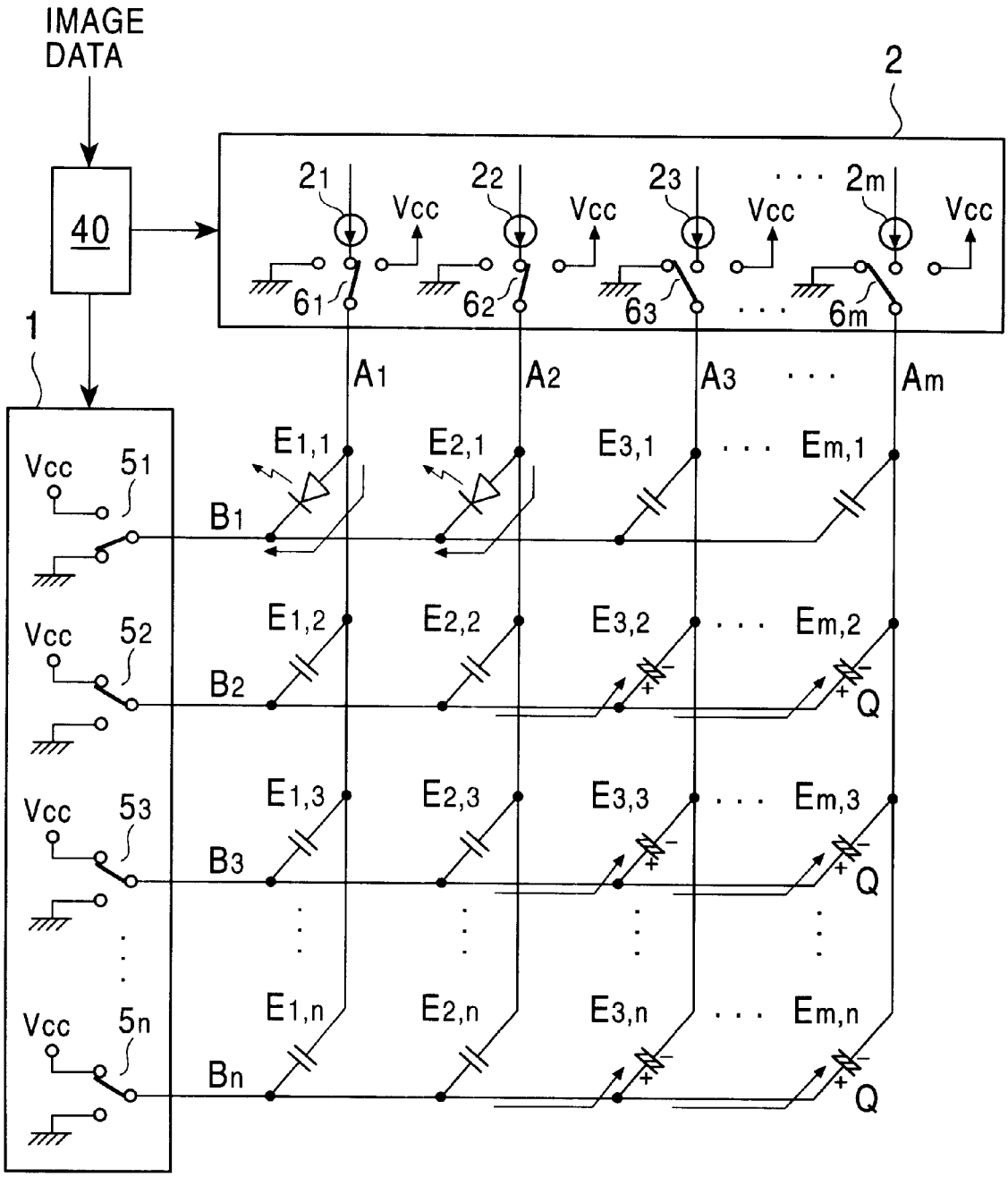
FIG. 11 is a block diagram for explaining the structure of a display apparatus having EL devices according to an embodiment of the present invention, and a $V_{cc}$/0V reset driving method which is adapted for the display apparatus.

First, in the first scan period, only the scan switch $\mathbf{5}_1$ is switched to the ground potential position, the cathode line $B_1$ is scanned, and the reverse bias voltage $V_{CC}$ is applied to the other cathode lines $B_2$–$B_n$ by the scan switches $\mathbf{5}_2$–$\mathbf{5}_n$ in FIG. 11. At the same time, the current sources $\mathbf{2}_1$ and $\mathbf{2}_2$ are connected to the anode lines $A_1$ and $A_2$ via the drive switches $\mathbf{6}_1$ and $\mathbf{6}_2$, while the other anode lines $A_3$–$A_m$ are switched to the ground potential position via the drive switches $\mathbf{6}_3$–$\mathbf{6}_m$. Therefore, only the devices $E_{1,1}$ and $E_{2,1}$ emit light, and at the same time the devices $E_{3,2}$ to $E_{3,n}$, . . . , and $E_{m,2}$ to $E_{m,n}$ are charged with the charges Q in the reverse direction as illustrated.

Figure 9:
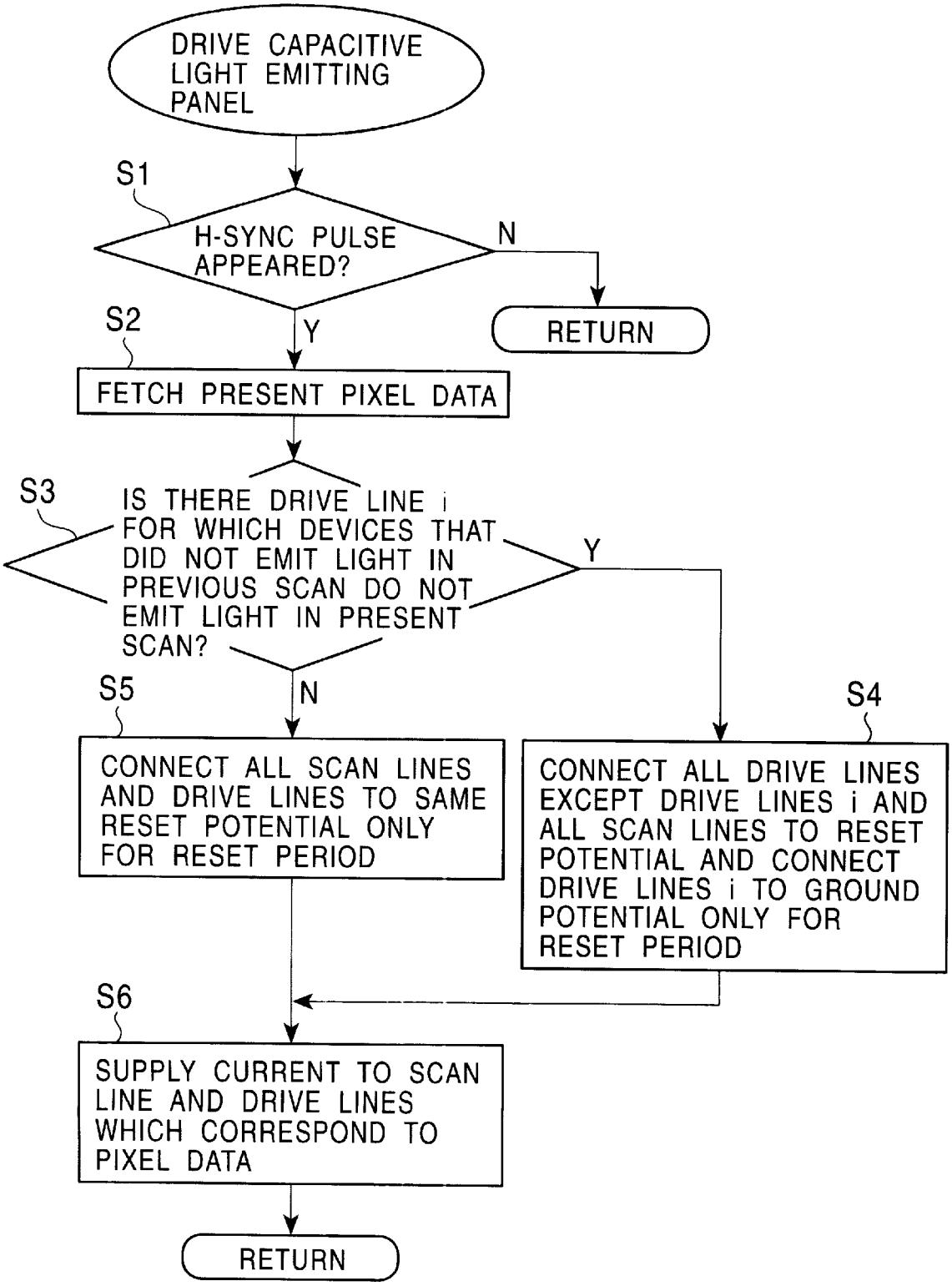
FIG. 9 is a flowchart illustrating a first mode of a reset driving method for the display apparatus according to the present invention.

In the reset period, the emission controller 40 has selected the drive (anode) lines $A_4$–$A_m$ on which there are no devices that should emit light in the first and second scan periods through the driving method illustrated in FIG. 9. Thus, the emission controller 40 switches the drive switches $\mathbf{6}_4$–$\mathbf{6}_m$ to the ground potential position, switches the drive switches $\mathbf{6}_1$, $\mathbf{6}_2$ and $\mathbf{6}_3$ to the reverse bias potential position, and switches all the scan switches $\mathbf{5}_1$–$\mathbf{5}_n$ to the reverse bias potential position, as shown in FIG. 12. As the resetting is implemented, the forward charges (i.e., charges in the forward direction) stored in the devices $E_{1,1}$ and $E_{2,1}$ and the reverse charges (i.e., charges in the reverse direction) stored in the devices $E_{3,2}$ to $E_{3,n}$ are all discharged, and the devices $E_{4,1}$, . . . , and $E_{m,1}$ are charged with the reverse charges Q along the routes indicated by the arrows in the diagram. The devices $E_{4,2}$ to $E_{4,n}$, . . . , and $E_{m,2}$ to $E_{m,n}$ keep holding the reverse charges Q without being charged nor being discharged.

Figure 13:
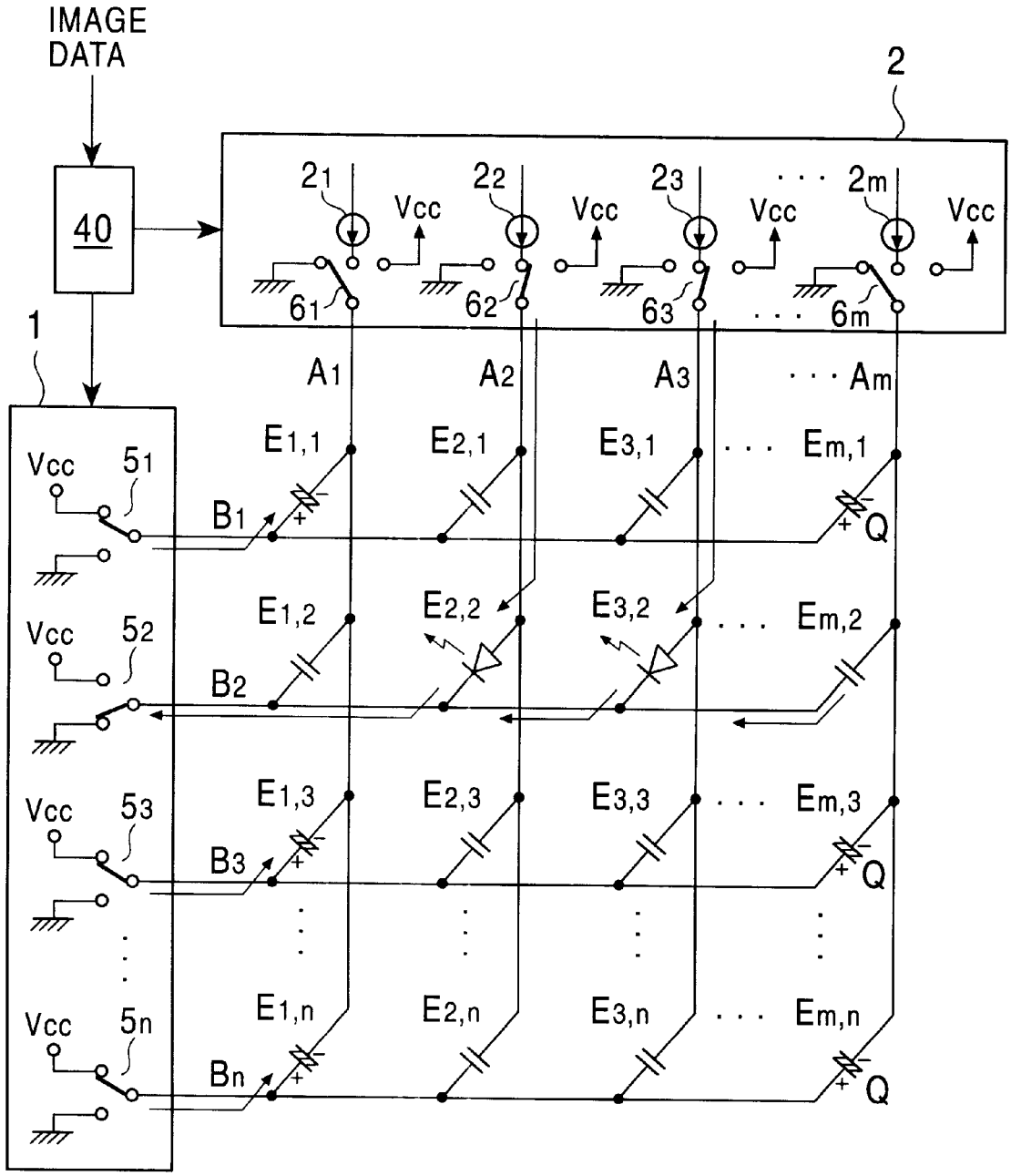
FIG. 13 is a block diagram for explaining the structure of the display apparatus having EL devices according to the embodiment of the present invention, and the $V_{cc}$/0V reset driving method which is adapted for the display apparatus.

Then, in the second scan period, only the scan switch $\mathbf{5}_2$ on the cathode line $B_2$ is switched to the ground potential position, the other scan switches are switched to the reverse bias voltage $V_{CC}$ to scan the cathode line $B_2$, and at the same time, the drive switches $\mathbf{6}_2$ and $\mathbf{6}_3$ are switched to the current sources $\mathbf{2}_2$ and $\mathbf{2}_3$ while the other drive switches $\mathbf{6}_1$–$\mathbf{6}_m$ are switched to the ground potential position, as shown in FIG. 13. Consequently, the charge current flow into the devices $E_{2,2}$ and $E_{3,2}$ that should emit light through a plurality of routes from the constant voltage sources connected to the cathode lines $B_1$ and $B_3$–$B_n$ as well as from the current sources $\mathbf{2}_2$ and $\mathbf{2}_3$ as per the prior art (see FIG. 6). The charge current can ensure instantaneous transition to the steady emission state. The current likewise flow into the devices $E_{1,1}$, $E_{1,3}$ to $E_{1,n}$ from the constant voltage sources of the reverse bias voltage $V_{CC}$, and are charged with the reverse charges Q, as per the prior art (see FIG. 6). As the devices $E_{4,1}$, $E_{4,3}$ to $E_{4,n}$, . . . , $E_{m,1}$, and $E_{m,3}$ to $E_{m,n}$ on the respective anode lines $A_4$, . . . , and $A_m$ are not charged or discharged and those devices keep holding the state in which the charge Q is in the reverse direction. The charges held in the devices $E_{4,2}$, . . . , and $E_{m,2}$ are discharged. Although the other devices than the devices $E_{2,2}$ and $E_{3,2}$ that should emit light are also charged along the routes indicated by the arrows in the diagram, they will not emit light erroneously because their charging direction is the reverse bias direction.

Figure 1:
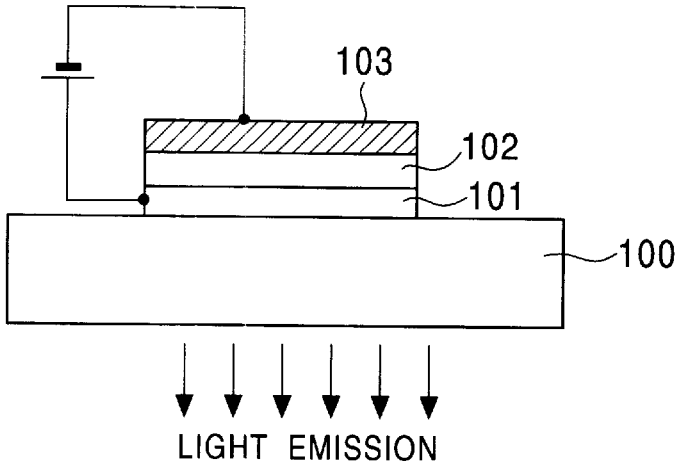
FIG. 1 is a cross-sectional view of an organic electroluminescence (EL) device.
Figure 2:
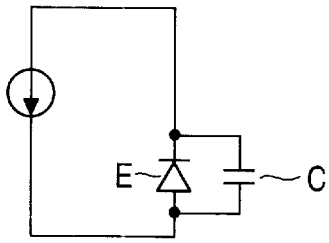
FIG. 2 is a diagram showing an equivalent circuit of an EL device.
Figure 3:
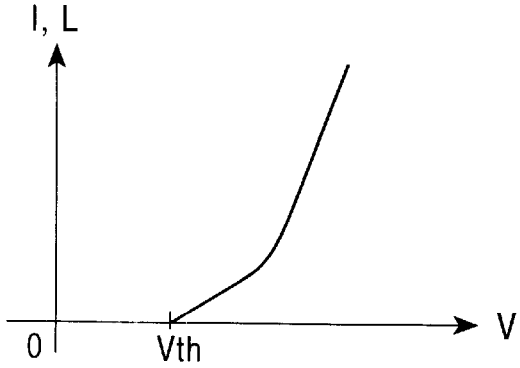
FIG. 3 is a graph schematically showing the drive voltage v.s. luminance characteristic of an EL device.
Figure 4:
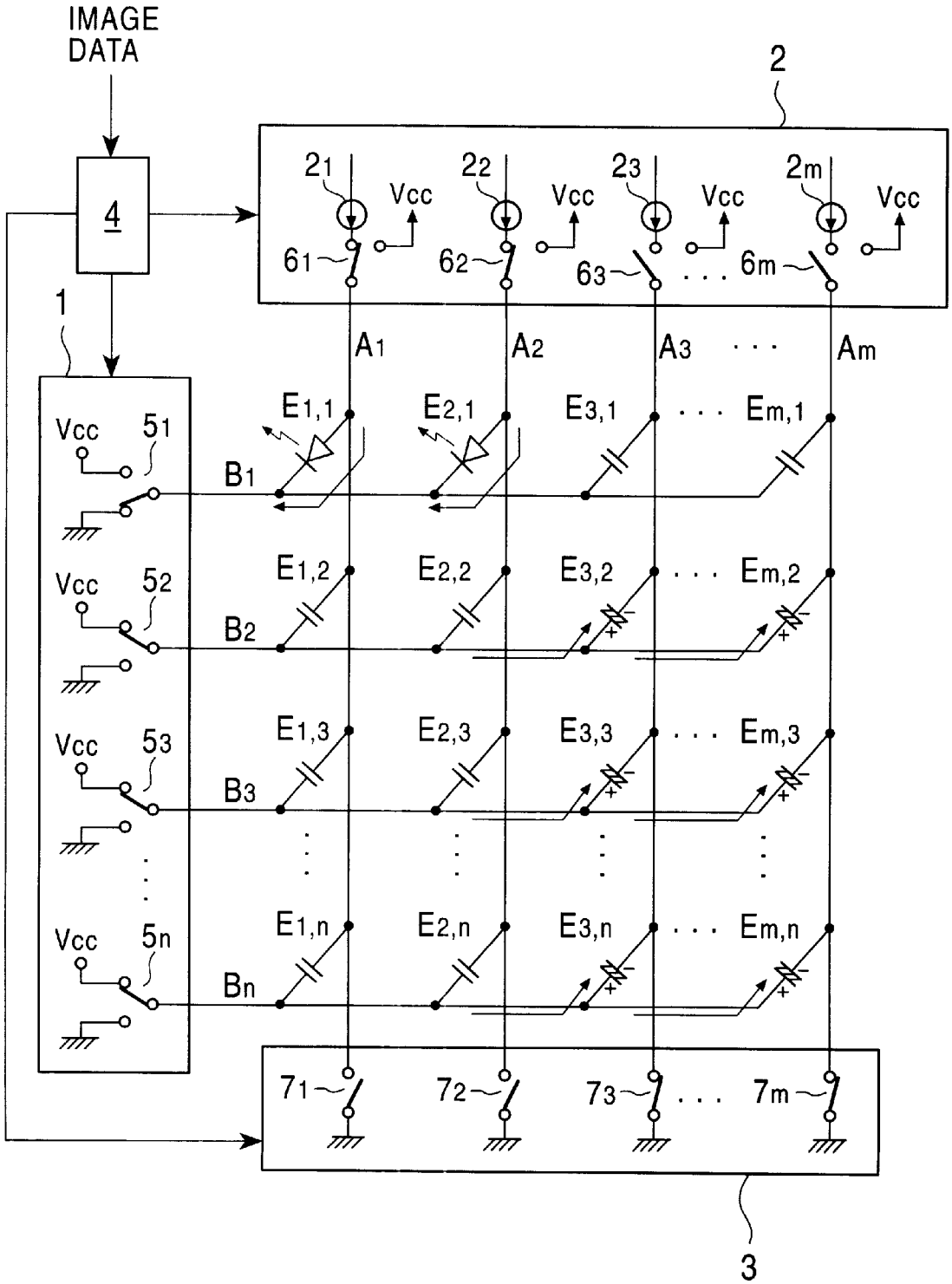
FIG. 4 is a block diagram for explaining the structure of a display apparatus which uses conventional EL devices and a 0-V (0 Volt) reset driving method which is adapted for the display apparatus.
Figure 5:
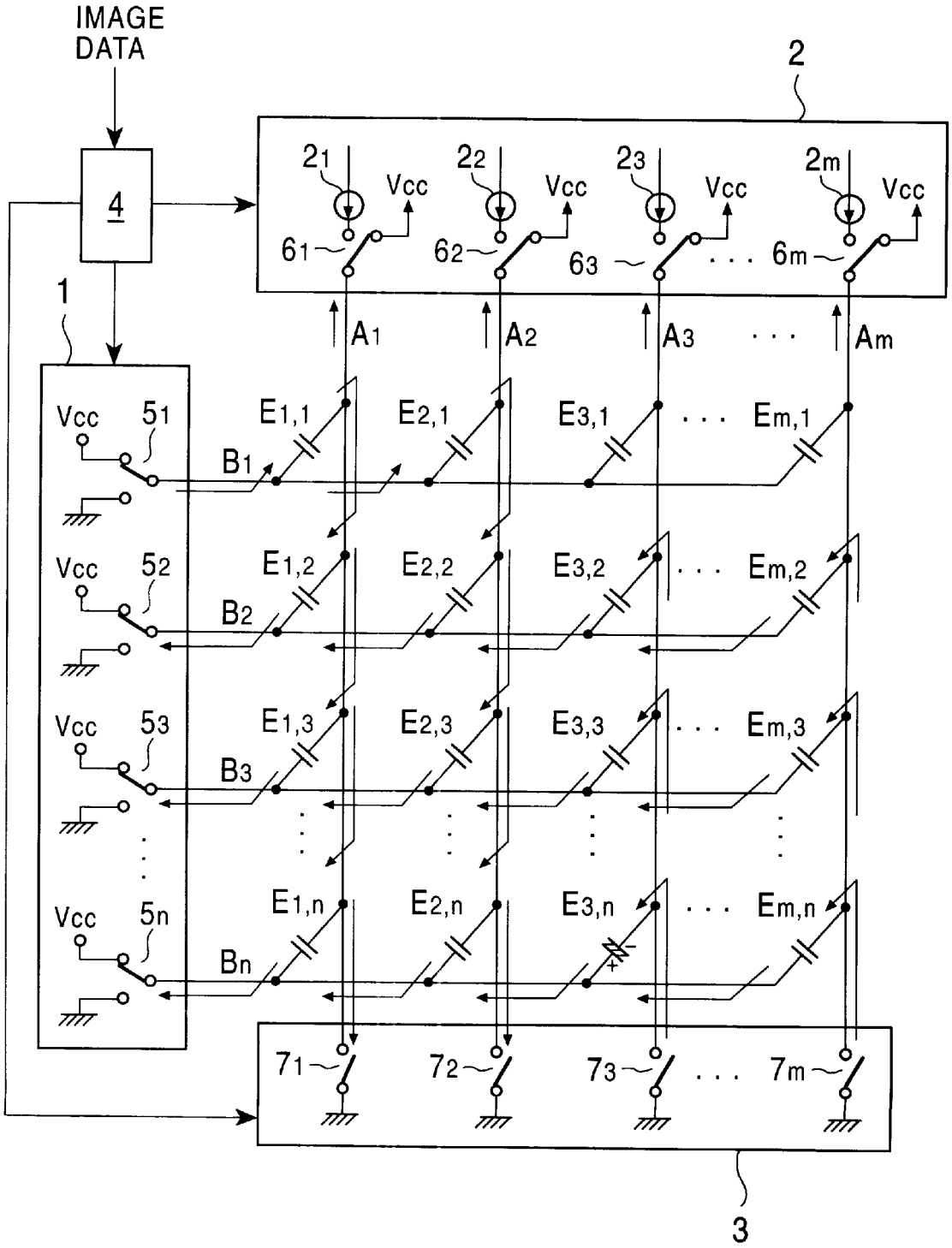
FIG. 5 is a block diagram for explaining the structure of the display apparatus which uses conventional EL devices and the 0-V reset driving method which is adapted for the display apparatus.
Figure 6:
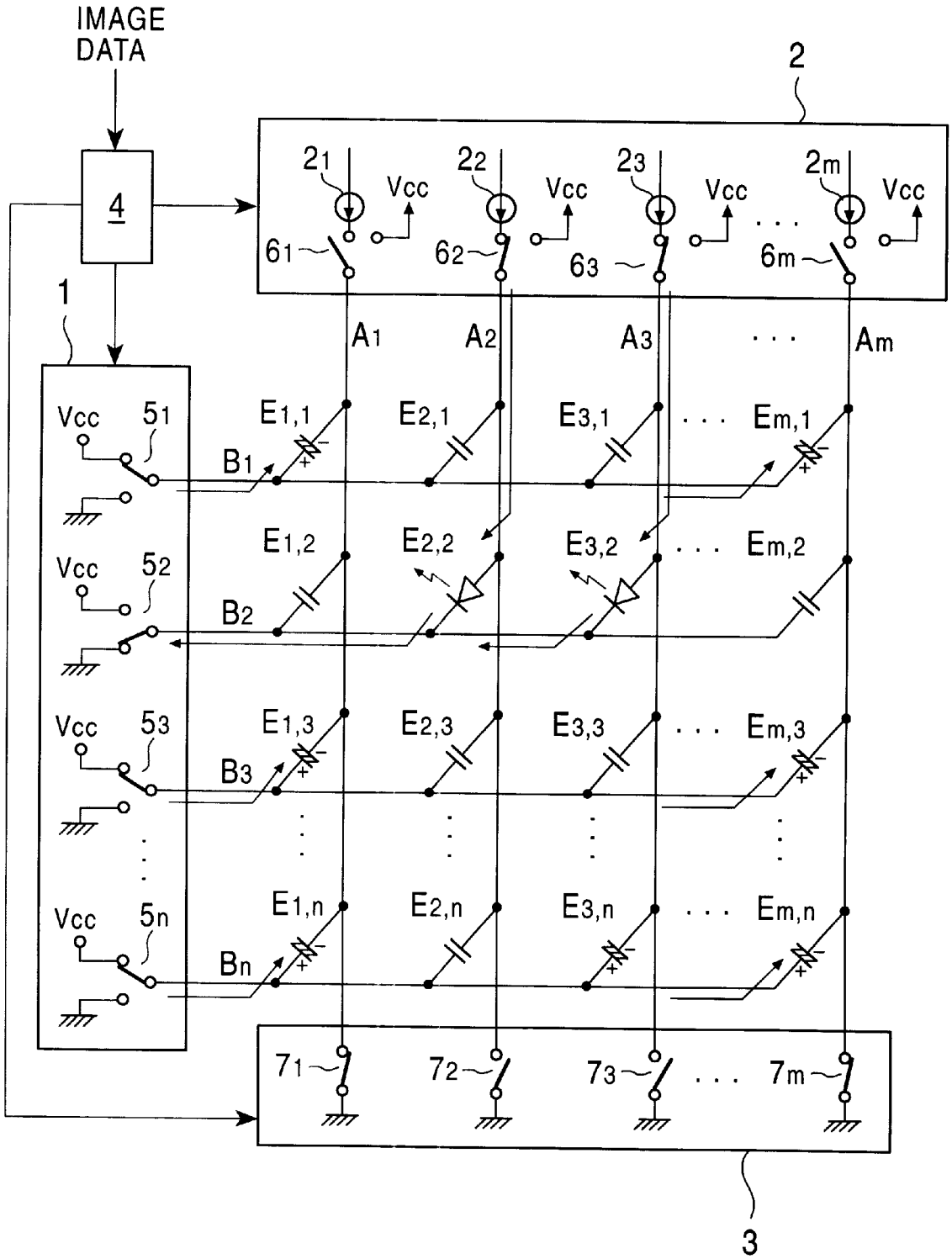
FIG. 6 is a block diagram for explaining the structure of the display apparatus which uses conventional EL devices and the 0-V reset driving method which is adapted for the display apparatus.
Figure 7A:
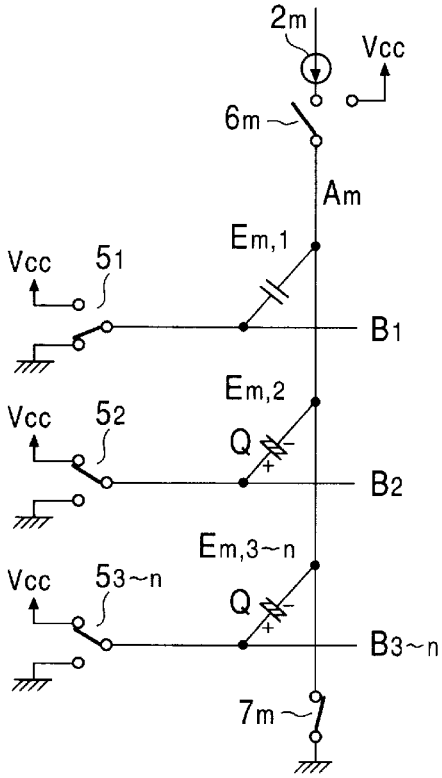
FIGS. 7A through 7C are schematic circuit diagrams for explaining the structure of the display apparatus which uses conventional EL devices and the 0-V reset driving method which is adapted for the display apparatus.
Figure 7B:
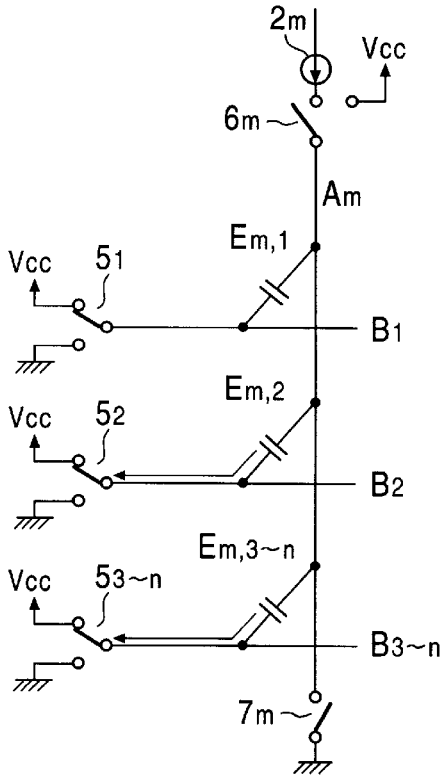
Figure 7C:
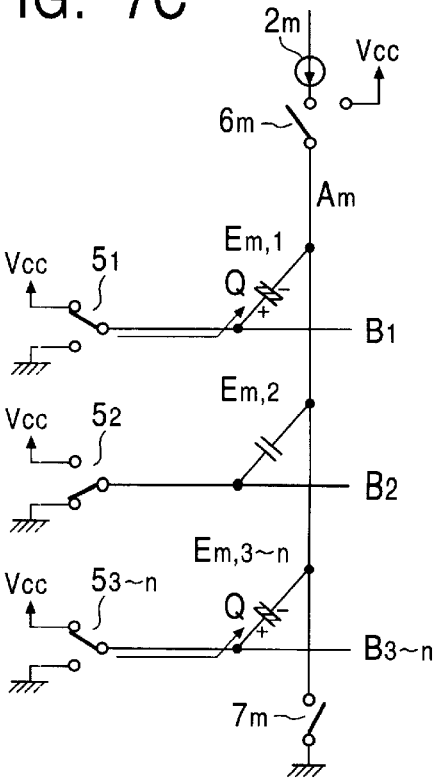

With regard to the consumed charges in the above scan switching operation, the amount of discharged charges at the reset operation and the amount of charged charges at the scan switching operation from/to the devices $E_{4,1}$ to $E_{4,n}$, . . . , and $E_{m,1}$ to $E_{m,n}$ are significantly reduced, which means that consumption of charges by the capacitive components of the devices that do not contribute to light emission is reduced greatly, as compared with those in the prior art (FIGS. 4 to 6).

Figure 14:
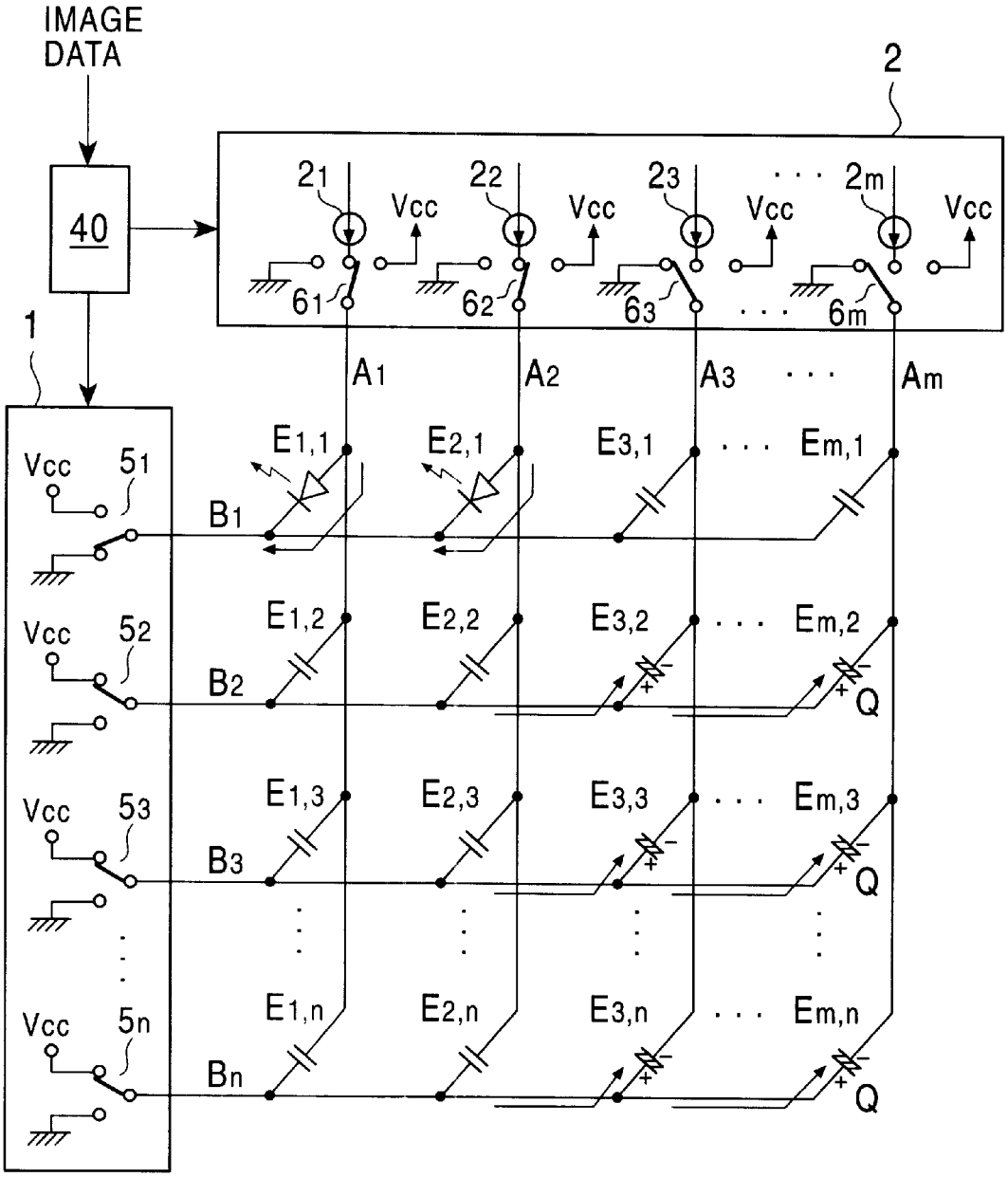
FIG. 14 is a block diagram for explaining the structure of a display apparatus having EL devices according to another embodiment of the present invention, and a $V_{cc}$/0V reset driving method which is adapted for the display apparatus.
Figure 15:
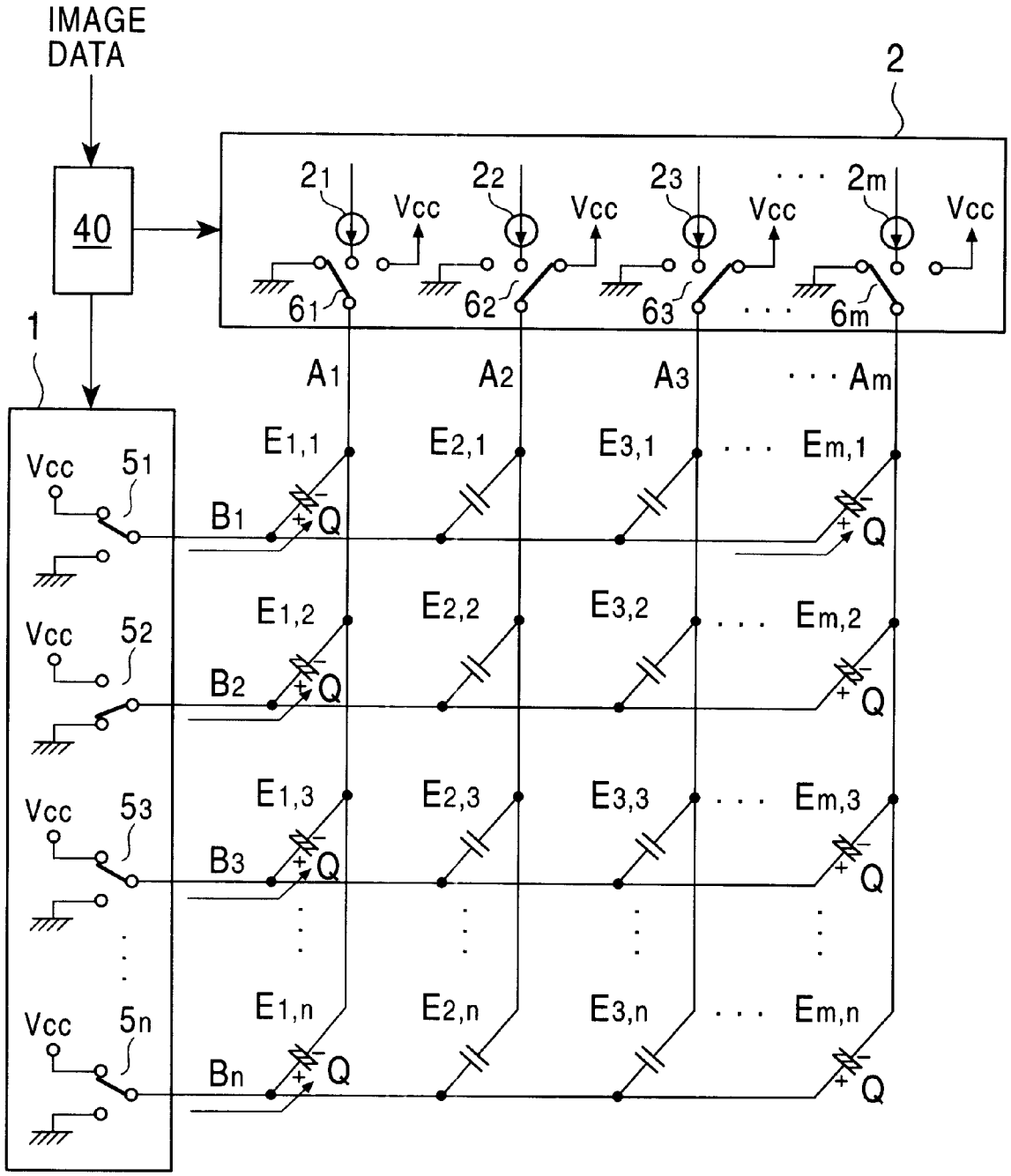
FIG. 15 is a block diagram for explaining the structure of the display apparatus having EL devices according to another embodiment of the present invention, and the $V_{cc}$/0V reset driving method which is adapted for the display apparatus.
Figure 16:
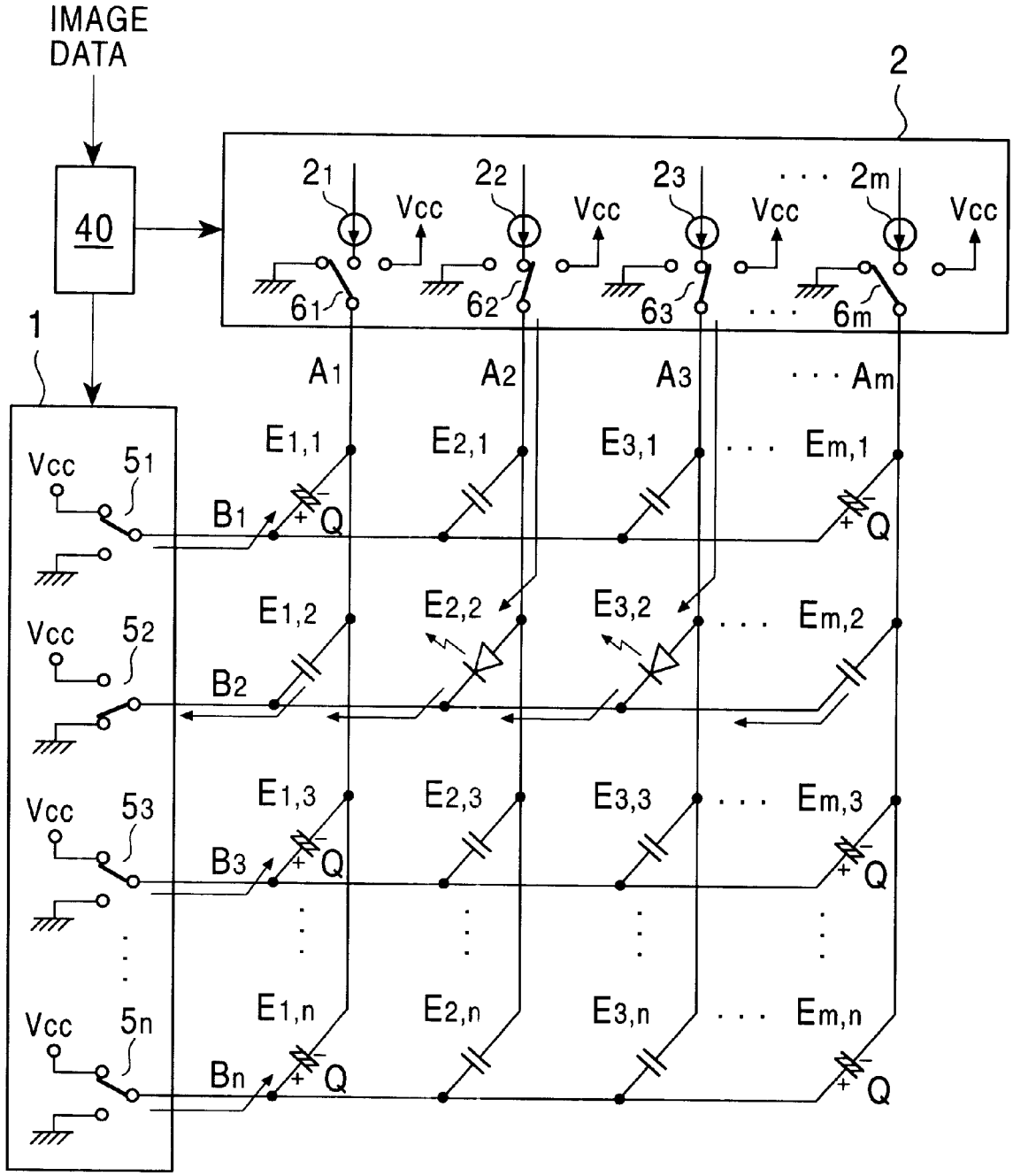
FIG. 16 is a block diagram for explaining the structure of the display apparatus using EL devices according to another embodiment of the present invention, and the $V_{cc}$/0V reset driving method which is adapted for the display apparatus.

A reset driving method according to a second embodiment of the present invention, which is also associated with the aforementioned second mode, is illustrated in FIGS. 14 through 16. The second embodiment is for a case where the reset potential is set equal to the ground potential, and the structure of the light emitting panel 120 is the same as the one shown in FIGS. 11 to 13.

Since the first scan mode illustrated in FIG. 14 is the same as the one shown in FIG. 11, its detailed description will not be repeated. In the reset period, the emission controller 40 has selected the drive (anode) lines $A_1$ and $A_4$–$A_m$ on which there are no devices that should emit light in the second scan period through the driving method illustrated in FIG. 10. Thus, the emission controller 40 switches the drive switches $\mathbf{6}_1$ and $\mathbf{6}_4$–$\mathbf{6}_m$ to the ground potential position, switches the drive switches $\mathbf{6}_2$ and $\mathbf{6}_3$ to the reverse bias voltage $V_{CC}$, and switches all the scan switches $\mathbf{5}_1$–$\mathbf{5}_n$ to the reverse bias voltage $V_{CC}$, as shown in FIG. 15.

When the resetting is carried out, the forward charges stored in the device $E_{2,1}$ and the reverse charges stored in the devices $E_{3,2}$ to $E_{3,n}$ are all discharged, all the devices $E_{1,1}$ to $E_{1,n}$ connected to the anode line $A_1$, and the devices $E_{4,1}$, . . . , and $E_{m,1}$ are charged with the reverse charges Q. The devices $E_{4,2}$ to $E_{4,n}$, . . . , and $E_{m,2}$ to $E_{m,n}$ keep holding the reverse charges Q without being charged or discharged.

Figure 12:
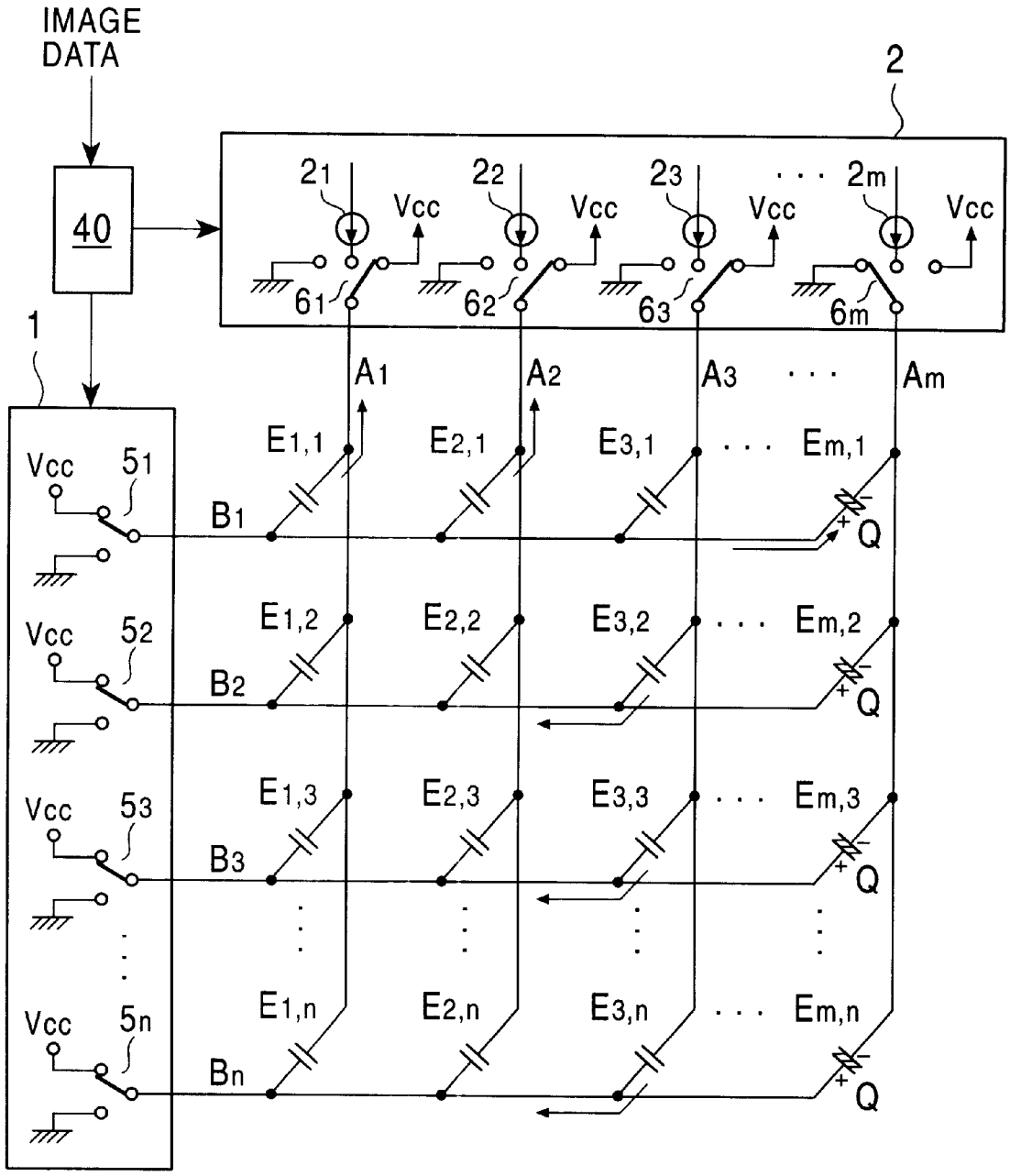
FIG. 12 is a block diagram for explaining the structure of the display apparatus having EL devices according to the embodiment of the present invention, and the $V_{cc}$/0V reset driving method which is adapted for the display apparatus.

Thereafter, in the second scan period, as shown in FIG. 16, only the scan switch $\mathbf{5}_2$ on the cathode line $B_2$ is switched to the ground potential position, the other scan switches are switched to the reverse bias voltage $V_{CC}$ to scan the cathode line $B_2$, and at the same time, the drive switches $\mathbf{6}_2$ and $\mathbf{6}_3$ are switched to the current sources $\mathbf{2}_2$ and $\mathbf{2}_3$ while the other drive switches are switched to the ground potential position, as in the case shown in FIG. 12.

Consequently, the charge current flow into the devices $E_{2,2}$ and $E_{3,2}$ that should emit light through a plurality of routes from the constant voltage sources connected to the cathode lines $B_1$ and $B_3$–$B_n$ as well as from the current sources $\mathbf{2}_2$ and $\mathbf{2}_3$ as per the prior art (see FIG. 6). The charge current can ensure instantaneous transition to the steady emission state. The devices $E_{1,1}$ and $E_{1,3}$ to $E_{1,n}$ on the anode line $A_1$ keep holding the reverse charges without being charged or discharged. Likewise, the devices $E_{4,1}$, $E_{4,3}$ to $E_{4,n}, \ldots, E_{m,1}$, and $E_{m,3}$ to $E_{m,n}$ on the respective anode lines $A_4, \ldots$, and $A_m$ keep holding the reverse charges without being charged or discharged.

With regard to the consumed charges in the above scan switching operation, the amount of discharged charges at the reset operation and the amount of charged charges at the scan switching operation from/to the devices $E_{4,1}$ to $E_{4,n}, \ldots$, and $E_{m,1}$ to $E_{m,n}$ are significantly reduced, which means that consumption of charges by the capacitive components of the devices that do not contribute to light emission is greatly reduced, as compared with those in the prior art (FIGS. 4 to 6). Since, in the embodiment, the anode lines that should be connected to the ground potential in reset mode is discriminated based only on image data for the present horizontal scan period (the j-th scan), the steps and means needed for the discrimination can be made simpler than the first mode.

It is also possible to set the reset potential equal to the reverse bias voltage $V_{CC}$ in the second mode. Although the cathode lines are laid horizontally and the anode lines vertically, their lying directions may be reversed. Although scanning is conducted with the electrodes that are laid horizontally and luminance is controlled with the electrodes that are laid vertically, scanning may be conducted with the vertically-laid electrodes and luminance may be controlled with the horizontally-laid electrodes. In the case of scanning with the anode lines, however, the drive sources of the anode lines and those of the cathode lines should be of the opposite polarities to those mentioned in the foregoing description.

According to the present invention, as specifically described above, provided is a method for driving a display apparatus with capacitive light-emitting devices which includes a plurality of capacitive light-emitting devices located at a plurality of intersections of drive lines and scan lines and respectively electrically connected between the scan lines and the drive lines, scan switches for connecting the scan lines to one of a first potential and a second potential different from each other when activated, drive switches for connecting the drive lines to either one of the first or second potential or a drive source when activated, and emission control means for controlling the drive switches and the scan switches, whereby the drive switches are activated so as to selectively connect the drive lines to the drive source to allow selected capacitive light-emitting devices to emit light in synchronism with scan timings at which the scan switches connect the scan lines to a lower one of the first and the second potentials. The method includes the steps of; (1) selecting non-connection keeping drive lines among all of the drive lines which are not connected to the drive source in a previous scan period and a present scan period, in the reset period, connecting all of the scan lines to the same reset potential and connecting the selected non-connection keeping drive lines to the ground potential while connecting the other drive lines to the reset potential, or (2) selecting unconnected drive lines among all of the drive lines which are not connected to the drive source in a present scan period, in the reset period, connecting all of the scan lines to the same reset potential and connecting the selected unconnected drive lines to the ground potential while connecting the other drive lines to the reset potential. The present invention can therefore provide a display apparatus with capacitive light-emitting devices, which quickens the rising of light emission without increasing power consumption.

Although several preferred embodiments of the present invention have been described herein, it should be apparent to those skilled in the art that the present invention may be embodied and modified in many other specific forms without departing from the spirit or scope of the present invention. All of such embodiments and modifications are to be considered as being included within the scope and equivalence of the appended claims.

What is claimed is:

1. A method for driving a display apparatus with capacitive light-emitting devices including a plurality of capacitive light-emitting devices located at a plurality of intersections of drive lines and scan lines and respectively electrically connected between said scan lines and said drive lines, scan switches for connecting said scan lines to one of a first potential and a second potential different from each other when activated, drive switches for connecting said drive lines to either one of said first or second potential or a drive source when activated, and emission control means for controlling said drive switches and said scan switches, whereby said drive switches are activated so as to selectively connect said drive lines to said drive source to allow selected capacitive light-emitting devices to emit light in synchronism with scan timings at which said scan switches connect said scan lines to a lower one of said first and said second potentials, comprising the steps of:

inserting a reset period between each of scan periods;

selecting unconnected drive lines among all of said drive lines which are not connected to said drive source in a present scan period; and connecting all of said scan lines to the same reset potential, connecting the selected unconnected drive lines to the ground potential and connecting the other drive lines to said reset potential in said reset period.

2. A method according to claim 1, wherein the selection of said unconnected drive lines is carried out in a reset period immediately before said present scan period.

3. A method according to claim 1, wherein one of said first potential and said second potential is a ground potential, while the other one is a potential greater than a potential difference between a specified emission voltage of said capacitive light-emitting devices and an emission threshold voltage.

4. A method according to claim 1, wherein one of said first potential and said second potential is a ground potential, while the other one is substantially equal to a specified emission voltage of said capacitive light-emitting devices.

5. A method according to claim 1, wherein said reset potential is equal to one of said first and second potentials that has higher potential.

6. A method according to claim 3, wherein the scan line to which said selected capacitive light-emitting devices are connected is connected to the ground potential, and the other scan lines are connected to a potential greater than said potential difference between said specified emission voltage of said capacitive light-emitting devices and said emission threshold voltage in said scan period.

7. A method according to claim 4, wherein the scan line to which said selected capacitive light-emitting devices are connected is connected to the ground potential, and the other scan lines are connected to a potential substantially equal to said specified emission voltage of said capacitive light-emitting devices in said scan period.

8. A method according to claim 3, wherein drive lines other than the drive line to which said selected capacitive light-emitting devices are connected are connected to the ground potential in said scan period.

9. A method according to claim 1, wherein said capacitive light-emitting devices are electroluminescence devices.

10. A method according to claim 1, wherein said capacitive light-emitting devices are located at intersections of a plurality of drive lines extending approximately in parallel to one another and a plurality of scan lines extending approximately perpendicularly to said drive lines and approximately in parallel to one another and respectively electrically connected between said scan lines and said drive lines.

11. A method for driving a display apparatus with capacitive light-emitting devices including a plurality of capacitive light-emitting devices located at a plurality of intersections of drive lines and scan lines and respectively electrically connected between said scan lines and said drive lines, scan switches for connecting said scan lines to one of a first potential and a second potential different from each other when activated, drive switches for connecting said drive lines to either one of said first or potential different from each other when activated, and emission control means for controlling said drive switches and said scan switches, whereby said drive switches are activated so as to selectively connect said drive lines to said drive source to allow selected capacitive light-emitting devices to emit light in synchronism with scan timings at which said scan switches connect said scan lines to a lower one of said first and said second potentials, said method comprising the steps of:

inserting a reset period between each of scan periods;

selecting non-connection keeping drive lines among all of said drive lines which are not connected to said drive source in a previous scan period and a present scan period in said reset period; and connecting all of said scan lines to the same reset potential, connecting the selected non-connection keeping drive lines to the ground potential and connecting the other drive lines to said reset potential in said reset period.

12. A method according to claim 11, wherein the selection of said non-connection keeping drive lines is carried out in a reset period immediately before said present scan period.

13. A method according to claim 11, wherein one of said first potential and said second potential is a ground potential, while the other one is a potential greater than a potential difference between a specified emission voltage of said capacitive light-emitting devices and an emission threshold voltage.

14. A method according to claim 11, wherein one of said first potential and said second potential is a ground potential, while the other one is substantially equal to a specified emission voltage of said capacitive light-emitting devices.

15. A method according to claim 11, wherein said reset potential is equal to one of said first and second potentials that has higher potential.

16. A method according to claim 13, wherein the scan line to which said selected capacitive light-emitting devices are connected is connected to the ground potential, and the other scan lines are connected to a potential greater than said potential difference between said specified emission voltage of said capacitive light-emitting devices and said emission threshold voltage in said scan period.

17. A method according to claim 14, wherein the scan line to which said selected capacitive light-emitting devices are connected is connected to the ground potential, and the other scan lines are connected to a potential substantially equal to said specified emission voltage of said capacitive light-emitting devices in said scan period.

18. A method according to claim 13, wherein drive lines other than the drive line to which said selected capacitive light-emitting devices are connected are connected to the ground potential in said scan period.

19. A method according to claim 11, wherein said capacitive light-emitting devices are electroluminescence devices.

20. A method according to claim 11, wherein said capacitive light-emitting devices are located at intersections of a plurality of drive lines extending approximately in parallel to one another and a plurality of scan lines extending approximately perpendicularly to said drive lines and approximately in parallel to one another and respectively electrically connected between said scan lines and said drive lines.

21. A display apparatus with capacitive light-emitting device comprising:

a plurality of capacitive light-emitting devices located at a plurality of intersections of drive lines and scan lines and respectively electrically connected between said scan lines and said drive lines;

scan switches for connecting said scan lines, when activated, to one of a first potential and a second potential different from each other;

drive switches for connecting said drive lines, when activated, to either one of said first potential, said second potential or a drive source different from each other; and a controller for controlling said drive switches and said scan switches in such a way that said drive switches are activated so as to selectively connect said drive lines to said drive source to allow selected capacitive light-emitting devices to emit light in synchronism with scan timings at which said scan switches connect said scan lines to a lower one of said first and said second potentials;

wherein said controller identifies unconnected drive lines among all of said drive lines which are not connected to said drive source in a present scan period, wherein said controller provides a reset period between each of scan periods, and wherein said controller controls so as to connect all of said scan lines to said first potential, to connect said unconnected drive lines to said second potential and to connect the other drive lines to said first potential in said reset period.

22. The display apparatus according to claim 21, wherein the identification of drive lines by said controller is carried out in a reset period immediately before said present scan period.

23. The display apparatus according to claim 21, wherein one of said first potential and said second potential is a ground potential, while the other one is a potential greater than a potential difference between a specified emission voltage of said capacitive light-emitting devices and an emission threshold voltage.

24. The display apparatus according to claim 21, wherein one of said first potential and said second potential is a ground potential, while the other one is substantially equal to a specified emission voltage of said capacitive light-emitting devices.

25. The display apparatus according to claim 21, wherein said first potential is higher than said second potential.

26. The display apparatus according to claim 23, wherein in each scan period, said controller controls so as to connect the scan line to which said selected capacitive light-emitting devices are connected, to said second potential, and to connect the other scan lines to a potential greater than said potential difference between said specified emission voltage of said capacitive light-emitting device and said emission threshold voltage.

27. The display apparatus according to claim 24, wherein in each scan period, said controller controls so as to connect the scan line to which said selected capacitive light-emitting devices are connected, to said second potential, and to connect the other scan lines to a potential substantially equal to said specified emission voltage of said capacitive light-emitting devices.

28. The display apparatus according to claim 23, wherein in each scan period, said controller controls so as to connect the drive lines other than the drive lines to which said selected capacitive light-emitting devices to emit light are connected, to said second potential.

29. The display apparatus according to 21, wherein said capacitive light-emitting devices are electroluminescence devices.

30. The display apparatus according to claim 21, wherein said capacitive light-emitting devices are located at intersections of a plurality of drive lines extending approximately in parallel to one another and a plurality of scan lines extending approximately perpendicularly to said drive lines and approximately in parallel to one another and respectively electrically connected between said scan lines and said drive lines.

31. A display apparatus with capacitive light-emitting devices comprising:

a plurality of capacitive light-emitting devices located at a plurality of intersections of drive lines and scan lines and respectively electrically connected between said scan lines and said drive lines;

scan switches for connecting said scan lines, when activated, to one of a first potential and a second potential different from each other;

drive switches for connecting said drive lines, when activated, to either one of said first potential, said second potential, or a drive source different from each other; and a controller for controlling said drive switches and said scan switches in such a way that said drive switches are activated so as to selectively connect said drive lines to said drive source to allow selected capacitive light-emitting devices to emit light in synchronism with scan timings at which said scan switches connect said scan lines to a lower one of said first and said second potentials, wherein said controller identifies non-connection keeping drive lines among all of said drive lines which are not connected to said drive source in a previous scan period and a present scan period, wherein said controller provides a reset period between each of scan periods, and wherein said controller controls so as to connect all of said scan lines to said first potential, to connect said non-connection keeping drive lines to said second potential, and to connect the other drive lines to said first potential in said reset period.

32. The display apparatus according to claim 31, wherein the identification of drive lines by said controller is carried out in a reset period immediately before said present scan period.

33. The display apparatus according to claim 31, wherein one of said first potential and said second potential is a ground potential, while the other one is a potential greater than a potential difference between a specified emission voltage of said capacitive light-emitting devices and an emission threshold voltage.

34. The display apparatus according to claim 31, wherein one of said first potential and said second potential is a ground potential, while the other one is substantially equal to a specified emission voltage of said capacitive light-emitting devices.

35. The display apparatus according to claim 31, wherein said first potential is higher than said second potential.

36. The display apparatus according to claim 33, wherein in each scan period, said controller controls so as to connect the scan line to which said selected capacitive light-emitting devices are connected, to said second potential, and to connect the other scan lines to a potential greater than said potential difference between said specified emission voltage of said capacitive light-emitting device and said emission threshold voltage.

37. The display apparatus according to claim 34, wherein in each scan period, said controller controls so as to connect the scan line to which said selected capacitive light-emitting devices are connected, to said second potential, and to connect the other scan lines to a potential substantially equal to said specified emission voltage of said capacitive light-emitting devices.

38. The display apparatus according to claim 33, wherein in each scan period, said controller controls so as to connect the drive lines other than the drive lines to which said selected capacitive light-emitting devices to emit light are connected, to said second potential.

39. The display apparatus according to 31, wherein said capacitive light-emitting devices are electroluminescence devices.

40. The display apparatus according to claim 31, wherein said capacitive light-emitting devices are located at intersections of a plurality of drive lines extending approximately in parallel to one another and a plurality of scan lines extending approximately perpendicularly to said drive lines and approximately in parallel to one another and respectively electrically connected between said scan lines and said drive lines.

41. A display apparatus, comprising:

a plurality of light-emitting devices respectively connected between a plurality of scan lines and a plurality of drive lines;

drive switches for selectively connecting said drive lines to a first potential, a second potential or a drive source, wherein said first potential is different from said second potential; and a controller that controls said drive switches to connect a first drive line of said drive lines to said drive source during a first scan period and to connect a second drive line of said drive lines to said second potential during said first scan period;

wherein said controller connects said second drive line to said second potential during a second scan period after said first scan period, and wherein said controller connects said first drive line to said first potential and said second drive line to said second potential during a reset period between said first scan period and said second scan period.

42. The display apparatus according to claim 41, further comprising:

scan switches for selectively connecting said scan lines to said first potential and said second potential.

43. The display apparatus according to claim 42, wherein said controller controls said scan switches to connect a first scan line of said scan lines to said second potential and a second scan line of said scan lines to said first potential during said first scan period, and wherein said controller controls said scan switches to connect said first scan line to said first potential and said second scan line to said second potential during said second scan period.

44. The display apparatus according to claim 43, wherein said controller controls said scan switches to connect said first scan line and said second scan line to said first potential during said reset period.

45. The display apparatus according to claim 41, wherein said controller connects said first drive line to said second potential during said second scan period.

46. The display apparatus according to claim 41, wherein said controller connects a third drive line to said first potential during said reset period and connects said third drive line to said drive source during said second scan period.

47. The display apparatus according to claim 46, wherein said controller connects said third drive line to said drive source during said first scan period.

48. The display apparatus according to claim 46, wherein said controller connects said third drive line to said second potential during said first scan period.

49. The display apparatus according to claim 46, wherein said controller connects said first drive line to said second potential during said second scan period.

50. The display apparatus according to claim 41, wherein said controller connects said first drive line to said drive source during said second scan period.

51. The display apparatus according to claim 41, wherein said controller connects a third drive line to said second potential during said reset period and connects said third drive line to said drive source during said first scan period.

52. The display apparatus according to claim 51, wherein said controller connects said third drive line to said second potential during said second scan period.

53. The display apparatus according to claim 51, wherein said controller connects said first drive line to said drive source during said second scan period.

54. A display apparatus, comprising:

a plurality of light-emitting devices respectively connected between a plurality of scan lines and a plurality of drive lines, wherein a first scan line is activated during a first scan period and a second scan line is activated during a second scan period and wherein said second scan period occurs after said first scan period;

drive switches for selectively connecting said drive lines to a first potential, a second potential or a drive source, wherein said first potential is different from said second potential; and a controller that controls said drive switches to connect a first drive line of said drive lines to said drive source during said second scan period and to connect a second drive line of said drive lines to said second potential during said second scan period;

wherein said controller connects said first drive line to said first potential and said second drive line to said second potential during a reset period between said first scan period and said second scan period.

55. The display apparatus according to claim 54, wherein said controller connects said first drive line to said drive source during said first scan period.

56. The display apparatus according to claim 55, wherein said controller connects said second drive line to said second potential during said first scan period.

57. The display apparatus according to claim 54, wherein said controller connects a third drive line to said drive source during said first scan period and connects said third drive line to said first potential during said reset period.

58. The display apparatus according to claim 57, wherein said controller connects said third drive line to said drive source during said second scan period.

59. The display apparatus according to claim 54, wherein said controller connects said first drive line to said drive source during said first scan period, wherein said controller connects said second drive line to said second potential during said first scan period, wherein said controller connects a third drive line to said drive source during said first scan period, wherein said controller connects said third drive line to said second potential during said reset period, and wherein said controller connects said third drive line to said second potential during said second scan period.

60. The display apparatus according to claim 54, wherein said controller connects said first drive line to said second potential during said first scan period.

61. The display apparatus according to claim 54, wherein said controller connects a third drive line to said drive source during said first scan period and connects said third drive line to said second potential during said reset period.

62. The display apparatus according to claim 61, wherein said controller connects said third drive line to said second potential during said second scan period.

63. The display apparatus according to claim 54, wherein said controller connects said second drive line to said second potential during said first scan period.

64. The display apparatus according to claim 62, wherein said controller connects said first drive line to said second potential during said first scan period, and wherein said controller connects said second drive line to said second potential during said first scan period.

65. The display apparatus according to claim 64, wherein said controller connects a fourth drive line to said drive source during said first scan period, connects said fourth drive line to said first potential during said reset period, and connects said fourth drive line to said drive source during said second scan period.

66. A method for driving a display apparatus, in which a plurality of light-emitting devices are respectively connected between a plurality of scan lines and a plurality of drive lines and in which drive switches selectively connect said drive lines to a first potential, a second potential or a drive source, comprising:

connecting a first drive line of said drive lines to said drive source during a first scan period;

connecting a second drive line of said drive lines to said second potential during said first scan period;

connecting said second drive line to said second potential during a second scan period after said first scan period; and connecting said first drive line to said first potential and said second drive line to said second potential during a reset period between said first scan period and said second scan period, wherein said first potential is different from said second potential.

67. The method according to claim 66, further comprising:

selectively connecting said scan lines to said first potential and said second potential via scan switches.

68. The method according to claim 67, further comprising:

connecting a first scan line of said scan lines to said second potential and a second scan line of said scan lines to said first potential during said first scan period, and connecting said first scan line to said first potential and said second scan line to said second potential during said second scan period.

69. The method according to claim 68, further comprising:

connecting said first scan line and said second scan line to said first potential during said reset period.

70. The method according to claim 66, further comprising:

connecting said first drive line to said second potential during said second scan period.

71. The method according to claim 66, further comprising:

connecting a third drive line to said first potential during said reset period; and connecting said third drive line to said drive source during said second scan period.

72. The method according to claim 71, further comprising:

connecting said third drive line to said drive source during said first scan period.

73. The method according to claim 71, further comprising:

connecting said third drive line to said second potential during said first scan period.

74. The method according to claim 71, further comprising:

connecting said first drive line to said second potential during said second scan period.

75. The method according to claim 66, further comprising:

connecting said first drive line to said drive source during said second scan period.

76. The method according to claim 66, further comprising:

connecting a third drive line to said second potential during said reset period; and connecting said third drive line to said drive source during said first scan period.

77. The method according to claim 76, further comprising:

connecting said third drive line to said second potential during said second scan period.

78. The method according to claim 76, further comprising connecting said first drive line to said drive source during said second scan period.

79. A method of driving a display apparatus, in which, a plurality of light-emitting devices are respectively connected between a plurality of scan lines and a plurality of drive lines, wherein a first scan line is activated during a first scan period and a second scan line is activated during a second scan period and wherein said second scan period occurs after said first scan period, and in which drive switches selectively connect said drive lines to a first potential, a second potential or a drive source, wherein said first potential is different from said second potential, the method comprising:

connecting a first drive line of said drive lines to said drive source during said second scan period;

connecting a second drive line of said drive lines to said second potential during said second scan period;

connecting said first drive line to said first potential and said second drive line to said second potential during a reset period between said first scan period and said second scan period.

80. The method according to claim 79, further comprising:

connecting said first drive line to said drive source during said first scan period.

81. The method according to claim 80, further comprising:

connecting said second drive line to said second potential during said first scan period.

82. The method according to claim 79, further comprising:

connecting a third drive line to said drive source during said first scan period; and connecting said third drive line to said first potential during said reset period.

83. The method according to claim 82, further comprising:

connecting said third drive line to said drive source during said second scan period.

84. The method according to claim 79, further comprising:

connecting said first drive line to said drive source during said first scan period;

connecting said second drive line to said second potential during said first scan period;

connecting a third drive line to said drive source during said first scan period;

connecting said third drive line to said second potential during said reset period; and connecting said third drive line to said second potential during said second scan period.

85. The method according to claim 84, further comprising:

connecting a fourth drive line to said second potential during said first scan period;

connecting said fourth drive line to said first potential during said reset period; and connecting said fourth drive line to said drive source during said second scan period.

86. The method according to claim 79, further comprising:

connecting said first drive line to said second potential during said first scan period.

87. The method according to claim 79, further comprising:

connecting a third drive line to said drive source during said first scan period; and connecting said third drive line to said second potential during said reset period.

88. The method according to claim 87, further comprising:

connecting said third drive line to said second potential during said second scan period.

89. The method according to claim 79, further comprising:

connecting said second drive line to said second potential during said first scan period.

90. The method according to claim 88, further comprising:

connecting said first drive line to said second potential during said first scan period; and connecting said second drive line to said second potential during said first scan period.

91. The method according to claim 90, further comprising:

connecting a fourth drive line to said drive source during said first scan period;

connecting said fourth drive line to said first potential during said reset period; and connecting said fourth drive line to said drive source during said second scan period.

92. A method for driving a display apparatus, in which a plurality of light-emitting devices are connected between scan lines and drive lines, the method comprising;

determining whether or not said light-emitting devices emit light during a present scan period; and during a reset period, applying a first potential to drive lines that are connected to at least one of said light-emitting devices which emits light during said present scan period; and during said reset period, applying a second potential to drive lines that are not connected to any of said light-emitting devices which emit light during said present scan period, wherein said reset period occurs between said present scan period and a previous scan period, and wherein said first potential is different than said second potential.

93. The method according to claim 92, further comprising:

storing image data to be displayed in a memory; and determining whether or not said light-emitting devices emit light during said present scan period based on said image data.

94. The method according to claim 92, further comprising:

scanning a present scan line during said present scan period; and scanning a previous scan line during said previous scan period.

95. The method according to claim 94, further comprising:

connecting said previous scan line and said present scan line to said first potential during said reset period.

96. A method for driving a display apparatus, in which a plurality of light-emitting devices are connected between scan lines and drive lines, the method comprising;

determining whether or not said light-emitting devices emit light during a present scan period;

determining whether or not said light-emitting devices emit light during a previous scan period;

during a reset period, applying a first potential to drive lines that are connected to said light-emitting devices which emit light during at least one of said present scan period and said previous scan period; and during said reset period, applying a second potential to drive lines that are not connected to any of said light-emitting devices which emit light during at least one of said present scan period and said previous scan period, wherein said reset period occurs between said present scan period and said previous scan period, and wherein said first potential is different than said second potential.

* * * * *